US005890438A

United States Patent [19]

Frankish

[11] Patent Number: 5,890,438

[45] Date of Patent: Apr. 6, 1999

[54] HEIGHT ADJUSTMENT SYSTEM FOR A DESK OR WORKSTATION

[75] Inventor: Roger Graham Frankish, Templestowe, Australia

[73] Assignee: Schiavello Commercial Interiors (Vic) Pty Ltd., Australia

[21] Appl. No.: 725,970

[22] Filed: Oct. 4, 1996

Related U.S. Application Data

[63] Continuation-in-part of Ser. No. 400,605, Mar. 8, 1995, Pat. No. 5,685,510.

[30] Foreign Application Priority Data

Mar. 7, 1996 [SG] Singapore ..... 9601442
Jul. 26, 1996 [AU] Australia ..... PO1297

[51] Int. Cl.[6] ..... A47B 9/00

[52] U.S. Cl. ..... 108/147; 108/147.19; 108/50.02

[58] Field of Search ..... 108/147, 147.11, 108/147.19, 50.02; 312/223.6, 223.1, 223.3

[56] References Cited

U.S. PATENT DOCUMENTS

| | | | |
|---|---|---|---|
| 1,783,661 | 12/1930 | Makoski et al. . | |
| 2,368,748 | 2/1945 | Doty . | |
| 3,210,846 | 10/1965 | Balkin . | |
| 3,253,284 | 5/1966 | St. John . | |
| 4,372,629 | 2/1983 | Propst et al. | 312/223.6 |
| 4,515,414 | 5/1985 | Werth, Jr. . | |
| 4,593,874 | 6/1986 | Dunagan . | |
| 4,627,364 | 12/1986 | Klein et al. . | |
| 4,702,621 | 10/1987 | Heinonen et al. . | |
| 4,762,072 | 8/1988 | Boundy et al. | 108/50.02 |
| 4,940,339 | 7/1990 | Amano . | |
| 4,957,376 | 9/1990 | Ward, Jr. . | |
| 5,022,327 | 6/1991 | Solomon . | |
| 5,031,869 | 7/1991 | Strater et al. . | |
| 5,337,678 | 8/1994 | Grout | 108/147 |
| 5,447,099 | 9/1995 | Adams et al. | 108/147 |
| 5,640,912 | 6/1997 | Diffrient | 108/50.02 |

FOREIGN PATENT DOCUMENTS

| | | | |
|---|---|---|---|
| 246818 | 10/1962 | Australia . | |
| 580366 | 6/1986 | Australia . | |
| 632297 | 2/1990 | Australia . | |
| 0 379 262 | 7/1990 | European Pat. Off. . | |
| 2 620 316 | 3/1989 | France . | |
| 33 41 535 | 5/1985 | Germany . | |
| 8100965 | 4/1981 | WIPO | 312/223.6 |

*Primary Examiner*—Jose V. Chen
*Attorney, Agent, or Firm*—Christensen O'Connor Johnson and Kindness PLLC

[57] ABSTRACT

A height adjustment system for a desk or workstation comprises plurality of height adjustable legs each having a first part in the form of a hollow column and a second part movable relative to the first part in a vertical direction. The second part of each leg includes a gearbox housing containing a crown gear provided on a vertically extending rotatable shaft and at least one pinion gear engageable with said crown gear. The gearbox housing includes ball bearing race assemblies for the crown and pinion gears which enable the height of two or more legs to be adjusted simultaneously by a single winding mechanism. The leg also includes a self-adjusting linear bearing between telescopically movable parts of the leg. The height adjustment system may also include a duct for cabling, a cable tray and a hinged duct cover pivotally attached to the top member.

48 Claims, 19 Drawing Sheets

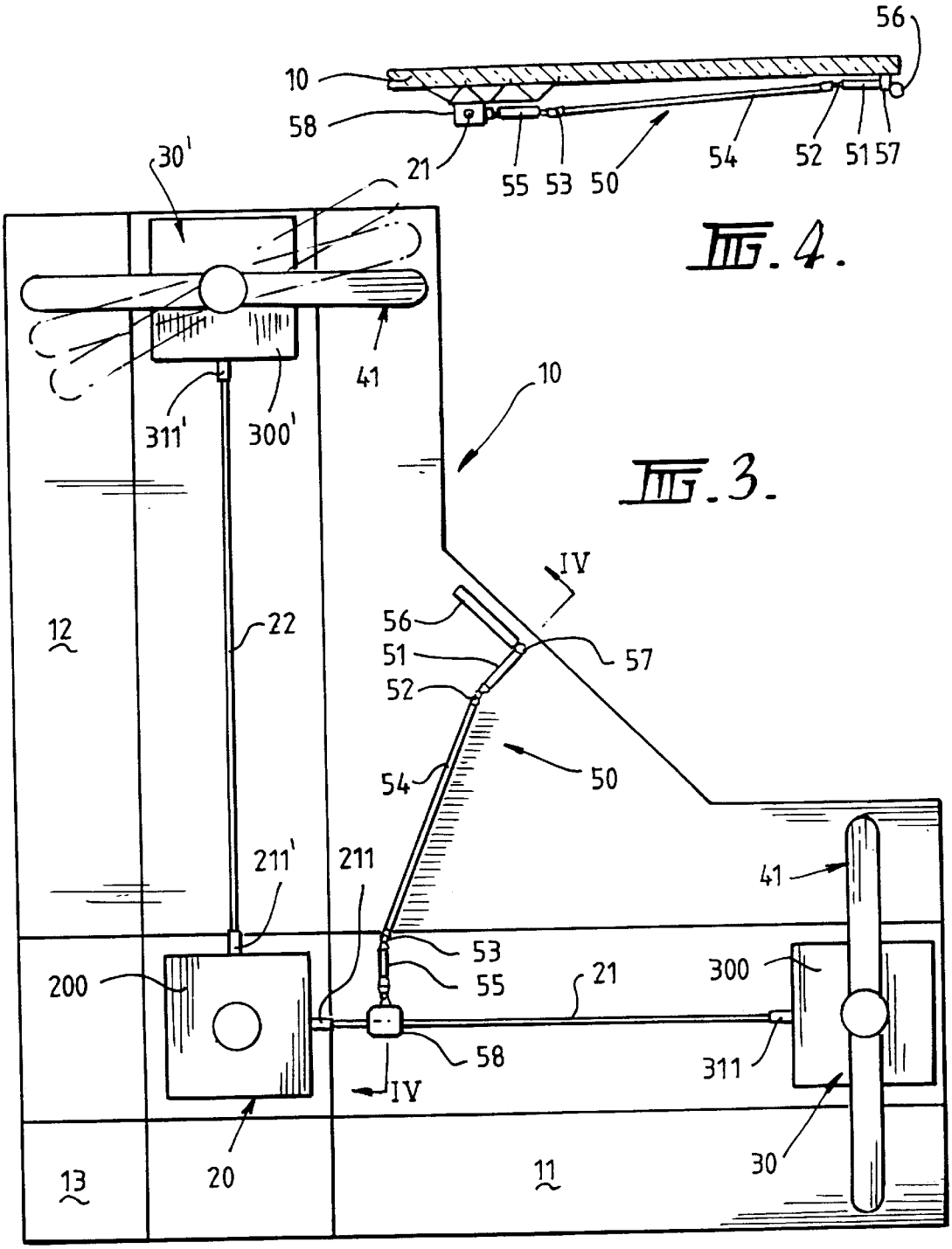
FIG. 4.
FIG. 3.
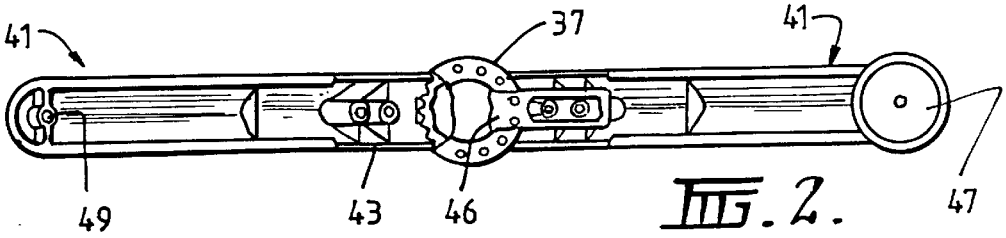
FIG. 2.

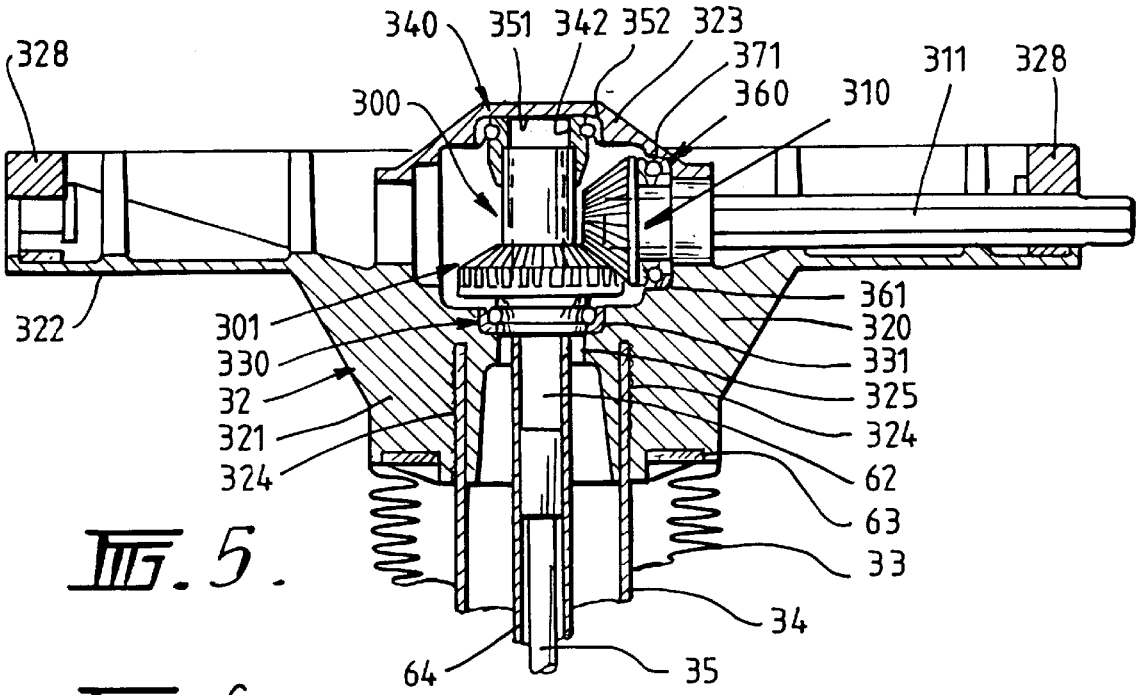
FIG. 5.
FIG. 6.
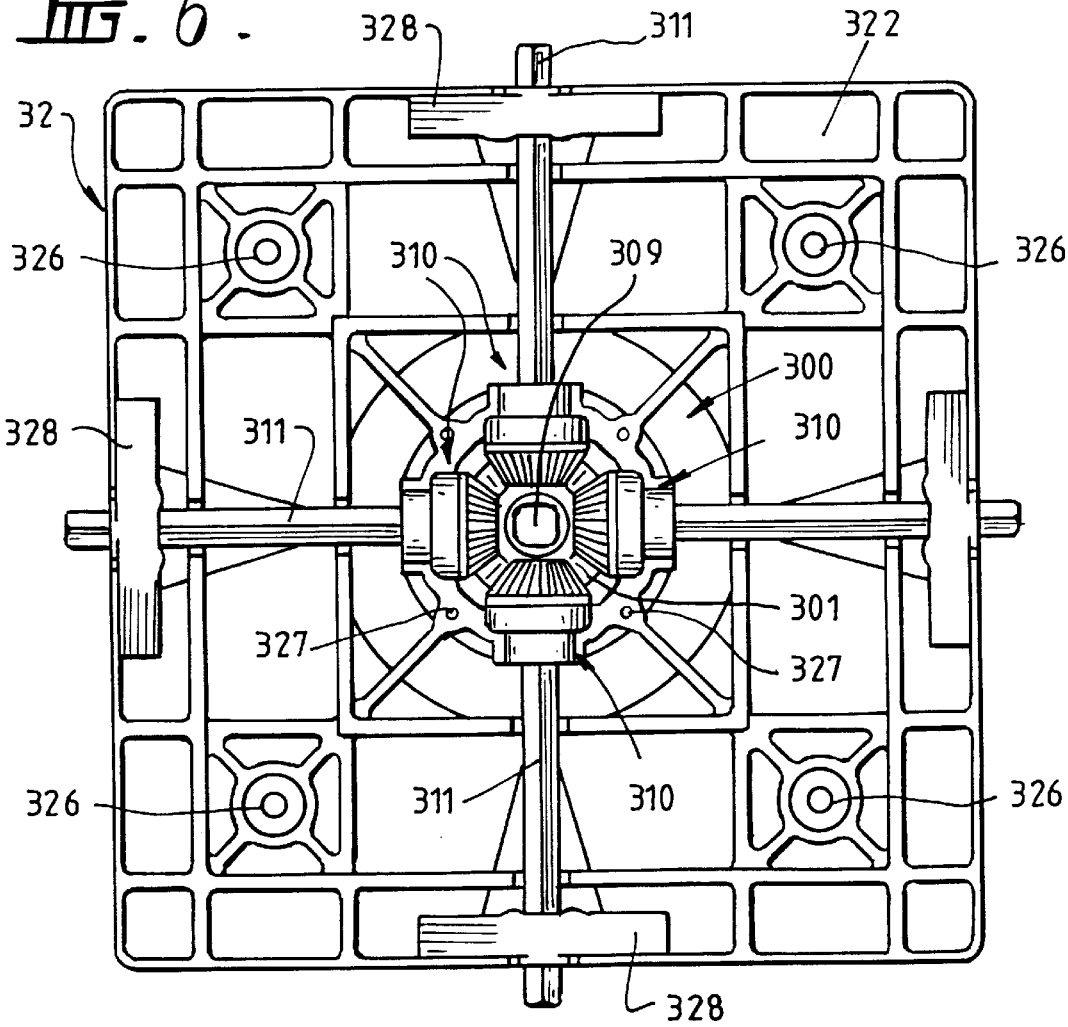

D
566
560
570
530
580
520
D 568
564
566
564
570
567
560
562

574
571
577
B
B
574

567
562
566
560
564
566
564

574
577
571

568
564
570
530'

574
570
577
571

HEIGHT ADJUSTMENT SYSTEM FOR A DESK OR WORKSTATION

This application is a continuation-in-part of application Ser. No. 08/400,605, filed Mar. 8, 1995 now U.S. Pat. No. 5,685,510.

This invention relates to height adjustable legs for a height adjustment system for desks, workstations and the like, and to height adjustment systems incorporating height adjustable legs.

Australian Patent No. 632297 discloses a desk height adjustment mechanism for a desk top member comprising a pair of leg members each having a first leg part fixed to the desk top member and a second leg part movable vertically relative to the first leg part to adjust the height of the desk top member relative to the leg. The first part of each leg has a rotatable vertically extending screw with a bevel gear at its upper end and the second part of each leg includes a nut engaged with the rotatable screw of the first leg part. The adjustable mechanism includes a horizontal rotatable shaft extending between the leg members and having a bevel gear at each end of the shaft engageable with the bevel gear of a respective rotatable screw, and drive means including a right-angle gearbox is provided for rotating the shaft to adjust the height of the legs simultaneously.

Australian Patent No. 632297 also discloses that the height of more than two legs can be adjusted simultaneously if the bevel gear at the top of the rotatable screw of at least one leg is engageable with bevel gears on two rotatable shafts extending perpendicularly relative to each other from said one leg to two other legs, said other legs having a respective rotatable vertical screw with a bevel gear at its upper end. However, it was found that the height adjustment system of Australian Patent No. 632297 did not operate satisfactorily when it was required to adjust the height of more than two legs simultaneously because of excessive frictional forces between relatively movable components of the system.

It is therefore desirable to provide an effective height adjustment system for multi-leg desks, workstations and the like which enables the height of two or more legs of the desk or workstation to be adjusted simultaneously.

It is also desirable to provide a height adjustable leg for desks, workstations or the like which has improved bearings between relatively movable components of the leg.

It is further desirable to provide an efficient, self-adjusting linear bearing for use in a height adjustable leg or other device having parts which are movable relative to each other in a linear direction.

With the increasing amount of electrical, computer and communications equipment used in office nowadays, it is also desirable to provide desks and workstations with means for concealing unsightly cabling required for the electrical, computer and/or communications equipment. This can be a particular problem in height adjustable desks and workstations which have adjustable legs with relatively movable parts.

According to a first aspect of the invention there is provided a height adjustable leg for a desk, workstation or like apparatus, the leg comprising a first leg part adapted to stand on a floor surface; and a second leg part adapted to be fixed relative to a top member of said desk, workstation or like apparatus, said second leg part being movable relative to said first leg part in a substantially vertical direction, said second leg part including a gearbox housing containing a crown gear rotatable about a substantially vertical axis and at least one pinion gear engageable with said crown gear about a substantially horizontal axis, said gearbox housing containing at least one ball bearing race assembly provided between said gearbox housing and at least one of said gears.

The gearbox housing may be formed in two parts and conveniently comprises a housing base member and a gearbox cover member.

The first leg part preferably comprises a substantially vertically extending hollow column and the second leg part includes a rotatable shaft extending vertically within the column and on which the crown gear is mounted.

The vertically extending rotatable shaft preferably has a screw-threaded portion and the first leg part, conveniently a base plate secured to the column, includes a nut engaged with said screw-threaded portion.

A pinion gear of the gearbox is preferably provided on a rotatable shaft which extends substantially horizontally out of the gearbox housing and which is adapted to be connected to drive means for rotating said horizontally extending rotatable shaft and the pinion gear. Rotation of the pinion gear causes rotation of the crown gear and the vertically extending shaft and rotation of the screw portion of the shaft causes the second leg part to move substantially vertically relative to the first leg part thereby adjusting the height of the top member of the desk or workstation supported by the height adjustable leg.

According to a second aspect of the invention there is provided a height adjustment system for a desk, workstation or like apparatus comprising at least one height adjustable leg in accordance with the first aspect of the invention, a desk- or work-top member fixed relative to said second leg part of the leg, and drive means connected to a pinion gear of the gearbox housing of the leg for rotating said pinion gear to cause the second leg part to move substantially vertically relative to the first leg part of the leg thereby adjusting the height of the desk- or work-top member.

The gearbox housing preferably includes a crown gear ball bearing race assembly provided between said crown gear and the gearbox housing, and a pinion gear ball bearing race assembly provided between the pinion gear and the gearbox housing.

The ball bearing race assemblies of the gearbox housing preferably include a first bearing race member having a substantially part-spherical concave surface, a second bearing race member having a substantially part-spherical concave surface and a plurality of ball bearings received between said concave surfaces of the first and second bearing race members.

The bearing race members of the ball bearing race assemblies are preferably formed from a low-friction plastics material. The crown and pinion gears may also be formed as mouldings of plastics material. The provision of gears and ball bearing race assemblies formed from a low-friction plastics material facilitates low cost production of very efficient gearboxes allowing more than one height adjustable leg of a height adjustment system for a desk or workstations to be driven from a single drive mechanism.

According to another aspect of the invention there is provided a height adjustment system for a desk, workstation or like apparatus comprising a plurality of height adjustable legs in accordance with the first aspect of the invention, the second part of each leg being secured to a generally horizontally extending top member, wherein the gearbox housing of at least one of said height adjustable legs includes a plurality of pinion gears engaged with the crown gear of the gearbox, one of said pinion gears being connected to drive means for rotating said pinion gear and the other pinion gear or gears being connected by drive transmission means to a pinion gear of another height adjustable leg of the system.

The second leg part of a height adjustable leg in accordance with the invention preferably includes a tubular member secured to and extending downwardly from the gearbox housing to surround the rotatable vertical shaft. In another advantageous feature of the invention a pair of low friction half nuts are received on the screw-threaded portion of said shaft and attached to the tubular member to assist in locating the shaft within the tubular member.

In accordance with a further advantageous feature of the invention at least one adjustable linear bearing is provided between the hollow column of the leg and the tubular member which is telescopically movable within the column in a substantially vertical direction. The adjustable linear bearing preferably comprises a bearing body fixed to one of the telescopically movable parts of the leg, said bearing body having upper and lower expandable regions providing bearing surfaces for the other telescopically movable part of the leg, and upper and lower wedge members received in respective recesses in said upper and lower regions for expanding said regions to compensate for wear of said bearing surfaces.

According to another aspect of the invention there is provided an adjustable linear bearing for a height adjustable leg or other device having first and second parts which are movable relative to each other in a linear direction, said linear bearing comprising a bearing body adapted to be fixed to one of said relatively movable parts of the device and having first and second longitudinally spaced expandable bearing regions, each bearing region providing a bearing surface for said other part of the device, and first and second wedge members received in respective recesses in said first and second bearing regions and adapted to expand said bearing regions of the bearing body to compensate for wear of said bearing surfaces.

Preferably, the linear bearing further comprises spring means for urging at least one of said wedge members into its recess in a respective one of said bearing regions so that the bearing automatically compensates for wear of the bearing surface of said bearing region.

The first and second wedge members of the linear bearing are preferably connected together in such a manner that said spring means urges both of said wedge members into their respective recesses in said first and second bearing regions.

In a particularly preferred embodiment, the linear bearing further comprises an elongate connecting member attached to said first wedge member and extending through a bore in said second wedge member, and spring means received on said elongate connecting member and arranged to urge said first and second wedge members into their respective recesses in said first and second bearing regions, whereby said linear bearing is automatically self-adjusting to compensate for wear of said bearing surfaces of said bearing regions.

The bearing body and the wedge members may be conveniently formed from a low friction plastics material, the wedge members having an angle of taper less than the friction angle of said low friction plastics material.

In accordance with a particularly preferred feature of the invention, a height adjustable leg of the height adjustment system includes a duct for cabling. The duct for cabling is preferably attached to the lower part of the leg so that when the upper leg part is moved to adjust the height of the desk- or work-top member, the duct and cabling therein does not move.

Such a duct for cabling may be incorporated within any type of height adjustment system for a desk, work-station or the like. According to a further aspect of the invention, there is provided a height adjustable leg for a desk, workstation or the like having a top member, wherein said leg comprises an upper leg part adapted to be fixed relative to the top member, a lower leg part, means for adjusting the height of the upper leg part and top member relative to the lower leg part, wherein the leg includes a duct for cabling attached to one of the leg parts.

A desk height adjustment system having a plurality of height adjustable legs may be provided with at least one cable tray extending substantially horizontally between ducts attached to the legs of the system receiving one or more cables. The cable tray is preferably secured to the upper ends of ducts attached to the lower leg parts of respective height adjustable legs. The duct and/or the cable tray is preferably divided into at least two compartments by partition means. One of the compartments may be provided for electricity cables with another of the compartments being provided for telecommunications cabling or computer cables.

In a particularly preferred embodiment, the duct and/or cable tray may include a power or communications socket of an electrical wiring system. The power or communications outlet socket is preferably provided at the top of the duct cable tray below the height of the top member of the desk or work station so that electrical, computer or telecommunications appliances can be readily connected to power or communications cables received by the duct or cable tray.

In accordance with a further preferred feature of the invention, a top member of a desk or workstation height adjustment system of the invention is provided with a duct or cable tray cover member. Preferably, the duct or cable tray cover member is connected to the top member in such a manner as to be movable from a first position in which the cover member extends substantially horizontally level with the top member to a second position which allows access to the cable duct or tray and any cables or outlet sockets the duct or tray may have.

According to yet another aspect of the invention, there is provided a desk, workstation or the like having at least one leg supporting a substantially horizontal top member, a cable duct or tray attached to the leg or legs, and a duct or tray cover member connected to the top member and movable from a first position covering the duct or tray to a second position allowing access to the duct or tray.

In a particularly preferred embodiment, the cover member is pivotally connected to an edge of the top member, and is pivotally movable through approximately 180° from the first position to a position in which the cover member lies substantially horizontally on the top member.

In accordance with another aspect of the invention, in a desk, workstation or the like, a height adjustable leg or legs of a height adjustment system are provided adjacent to a side or rear edge of a desk- or work top member of the desk or workstation, with the top member being supported in a cantilever arrangement from support beams extending between the legs of the system. This feature is particularly desirable when a cable duct or tray is to be connected to the leg or legs.

In a preferred cantilever support arrangement in accordance with the invention, the support beams are clamped between upper and lower clamping members with the upper clamping members being secured to the work-top. The lower clamping members may comprise, or be secured to, upper parts of the legs of the desk or work-station. Alternatively, or additionally, the upper and lower clamping members may be provided to clamp the support beams at locations between the legs.

When the system includes a plurality of height adjustable legs, a pair of support beams are preferably provided extending substantially horizontally between adjacent legs.

Preferably, a pair of spaced apart support beams extend between adjacent legs of the desk or work-station. The support beams are preferably disposed at substantially the same horizontal level and extend substantially parallel to each other between adjacent legs.

The upper and lower clamping members may be secured together with a support beam clamped therebetween by any convenient securing means. Preferably strong bolts, such as coach bolts are used to secure the clamping members to each other. The support beams are preferably formed from a strong metallic material, such as roll-formed steel.

In accordance with a particularly preferred feature of the invention the upper and lower clamping members have projections and/or recesses which engage with complementary recesses and/or projections in the support beams. This arrangement of the spaced apart support beams clamped between clamping members provided with projections and/or recesses engaging with complementary recesses and/or projections in the support beams results in a very strong cantilever support for a work-top in which torsional forces are minimized.

The upper and lower clamping members may comprise clamping plates having horizontal dimensions similar to the horizontal extent of the spaced apart support beams. Alternatively, the upper clamping member may comprise a cantilever support arm having a body part which is secured to the lower clamping members to clamp the beams and an arm portion extending in a substantially horizontal direction from the support beams.

Preferred embodiments of the present invention will now be described, by way of example only, with reference to the accompanying drawings, in which:

FIG. 2 is an underneath view of the height adjustable leg of FIG. 1;

FIG. 3 is a schematic underneath plan view of a height adjustment system incorporating a plurality of height adjustable legs of the kind shown in FIG. 1;

FIG. 4 is a section on the line IV—IV of FIG. 3 showing the drive mechanism for the height adjustment system;

FIG. 5 is an enlarged sectional view through a gearbox at the upper end of the leg of FIG. 1;

FIG. 6 is a top plan view of the gearbox of FIG. 5 with its cover removed;

Figure 1:
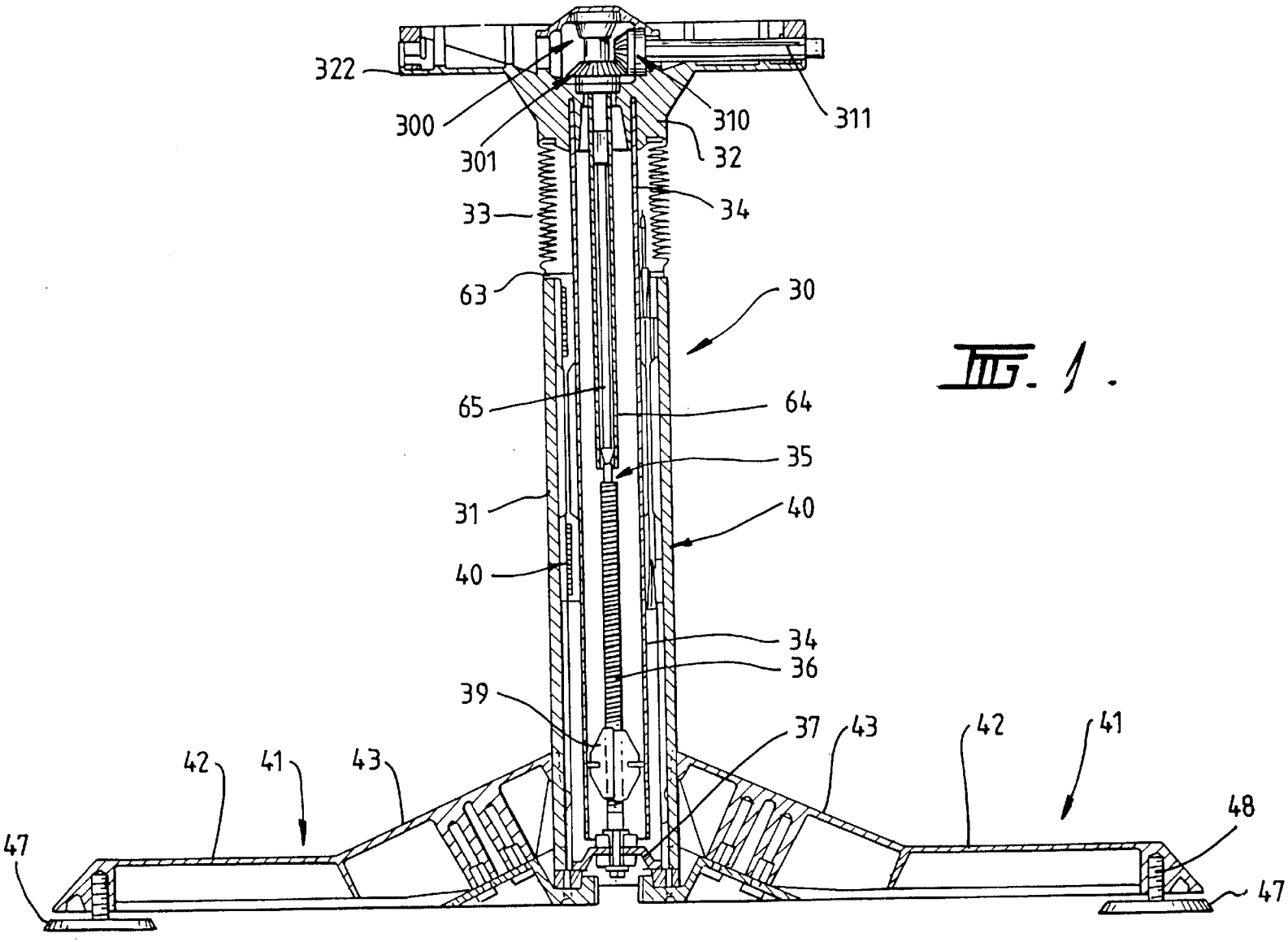
FIG. 1 is a section through a height adjustable leg of a height adjustment system in accordance with the invention.

The height adjustment system shown in the drawings comprises a desk- or work-top member 10 supported by a plurality of height adjustable legs 20, 30, 30' each incorporating a right-angle gearbox 200, 300, 300' at its upper end and a drive mechanism 50 arranged to adjust the height of the legs simultaneously.

The top member 10 shown in FIG. 3 is substantially L-shaped having first and second limbs 11 and 12 extending in perpendicular directions. The leg 20 supporting the corner region 13 of the L-shaped work top member 10 has a right-angle gearbox 200 from which two shafts 211, 211' extend in perpendicular directions. The ends of the shafts 211, 211' are connected to the ends of respective rotatable transmission members 21, 22 which extend along the under-surface of the top member 10. The opposite ends of the transmission members 21, 22 are connected to ends of rotatable shafts 311, 311' which extend out of right-angle gearboxes 300, 300' at the upper ends of the legs 30, 30'. It will, however, be appreciated that in a height adjustment system in accordance with the invention the top member may be of any desired shape and be supported by any number of height adjustable legs each having a right-angle gearbox connected to the right-angle gearbox of at least one other leg and/or to the drive mechanism.

FIG. 1 of the drawings shows one of the legs 30 of the system in section. The leg 30 has a first leg part in the form of a hollow cylindrical upright column 31 preferably formed from aluminum and a relatively movable second leg part in the form of an inner tubular member 34 secured to a housing 32 for the right-angle gearbox 300 at the upper end of the leg 30.

The upper end of the column 31 is connected to the lower end of the gearbox housing 32 by an expandable bellows member 33 which allows the gearbox housing 300 to move in a vertical direction relative to the column 31. The bellows member 33 is preferably formed from PVC and may be secured to the gearbox housing 32 and to the upper end of the column 31 by a self-anchoring bellows plate 63 or any other convenient attachment means. The tubular member 34 is preferably formed of steel and is secured to and extends downwardly from the gearbox housing 32 inside the hollow column 31.

Figure 18:
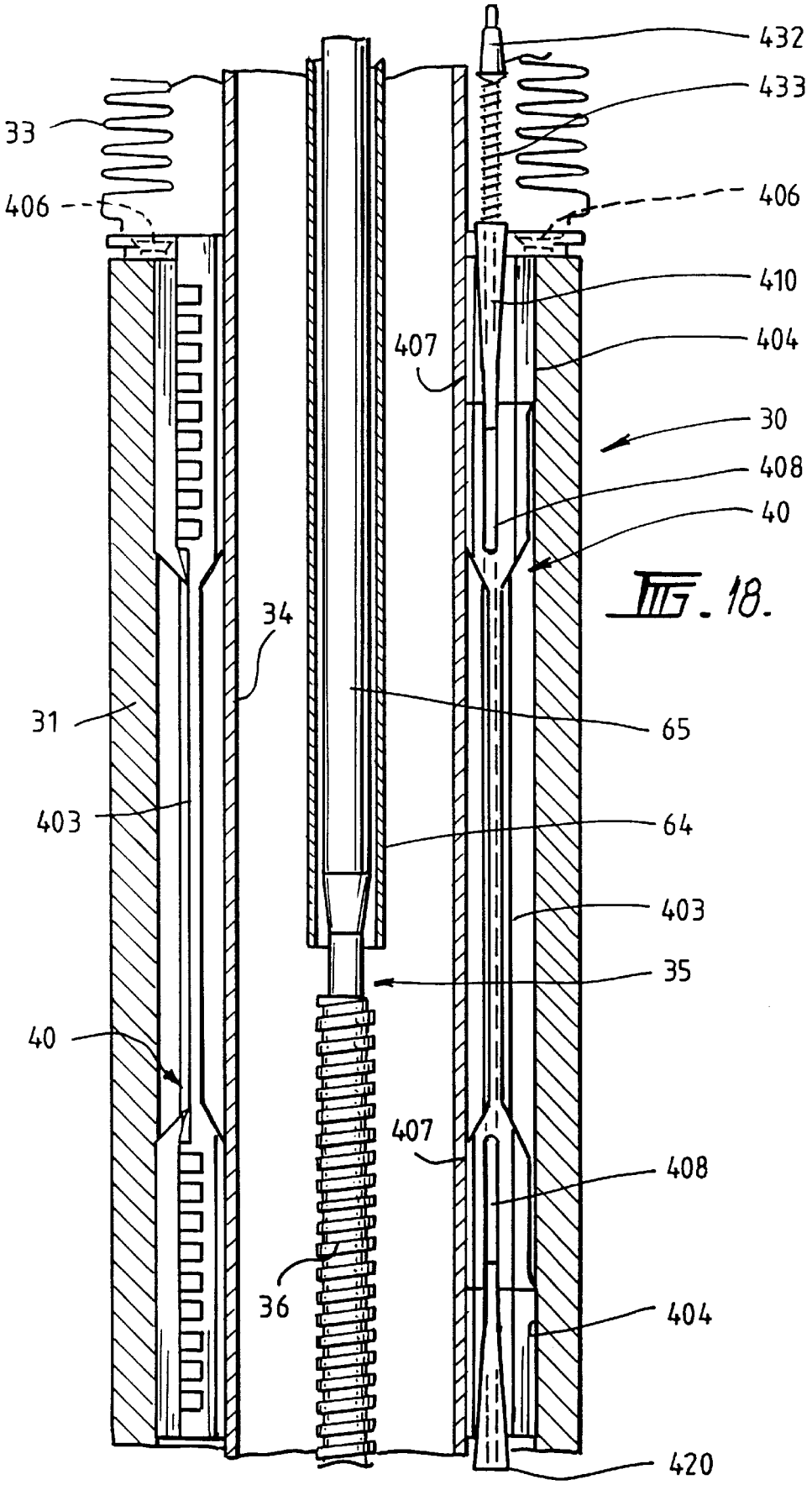
FIG. 18 is a section through the middle region of the height adjustable leg of FIG. 1 which includes a self-adjusting linear bearing assembly.
Figure 19:
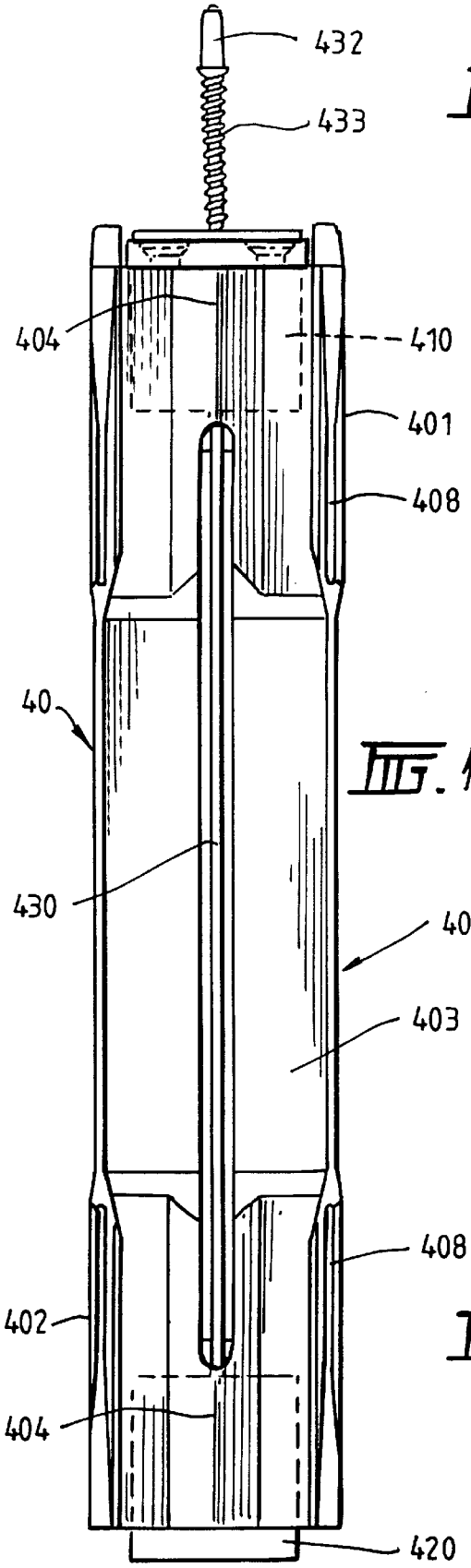
FIG. 19 is a side view of the linear bearing assembly.
Figure 27:
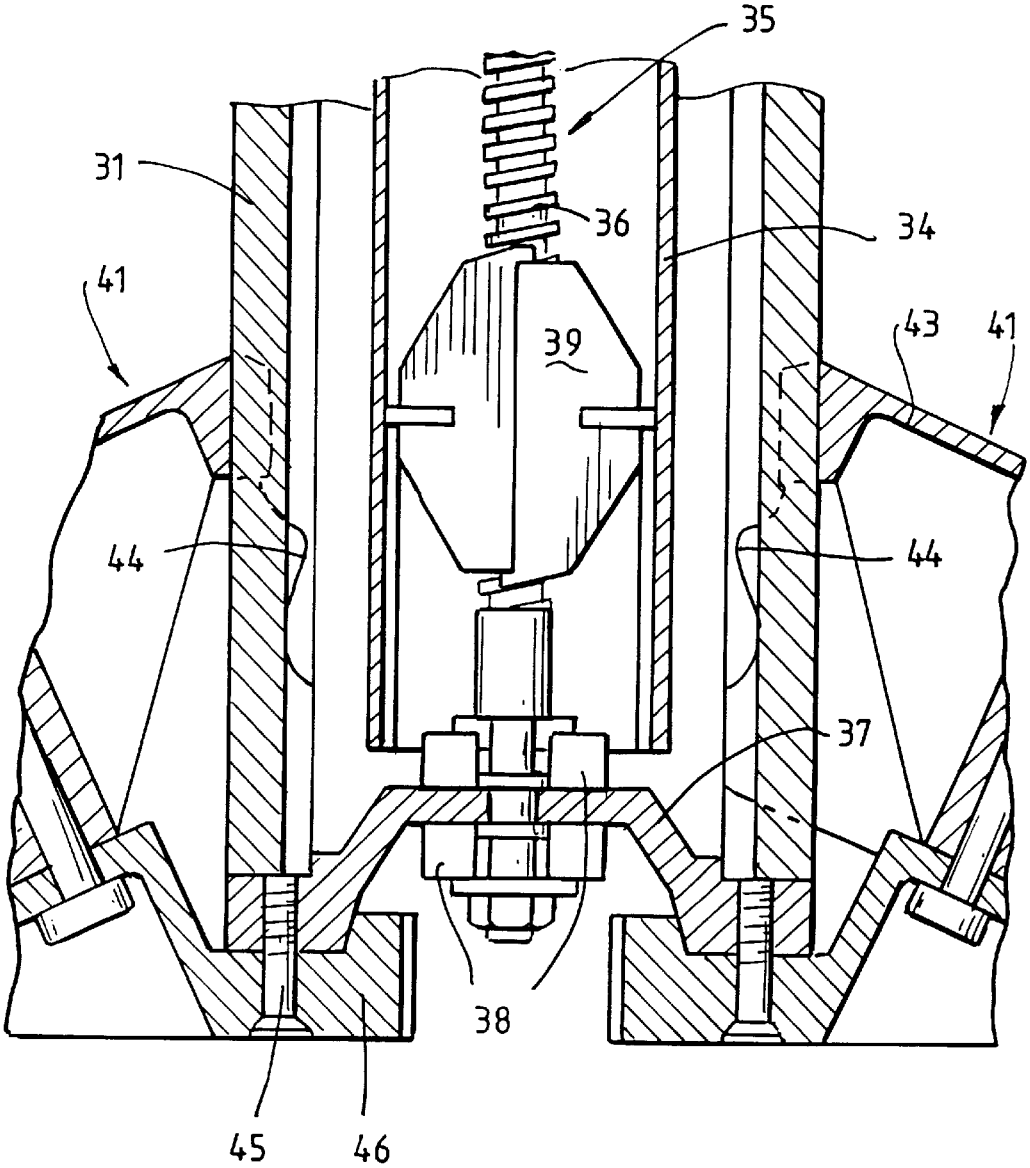
FIG. 27 is a section through the lower region of the height adjustable leg of FIG. 1.
Figure 29:
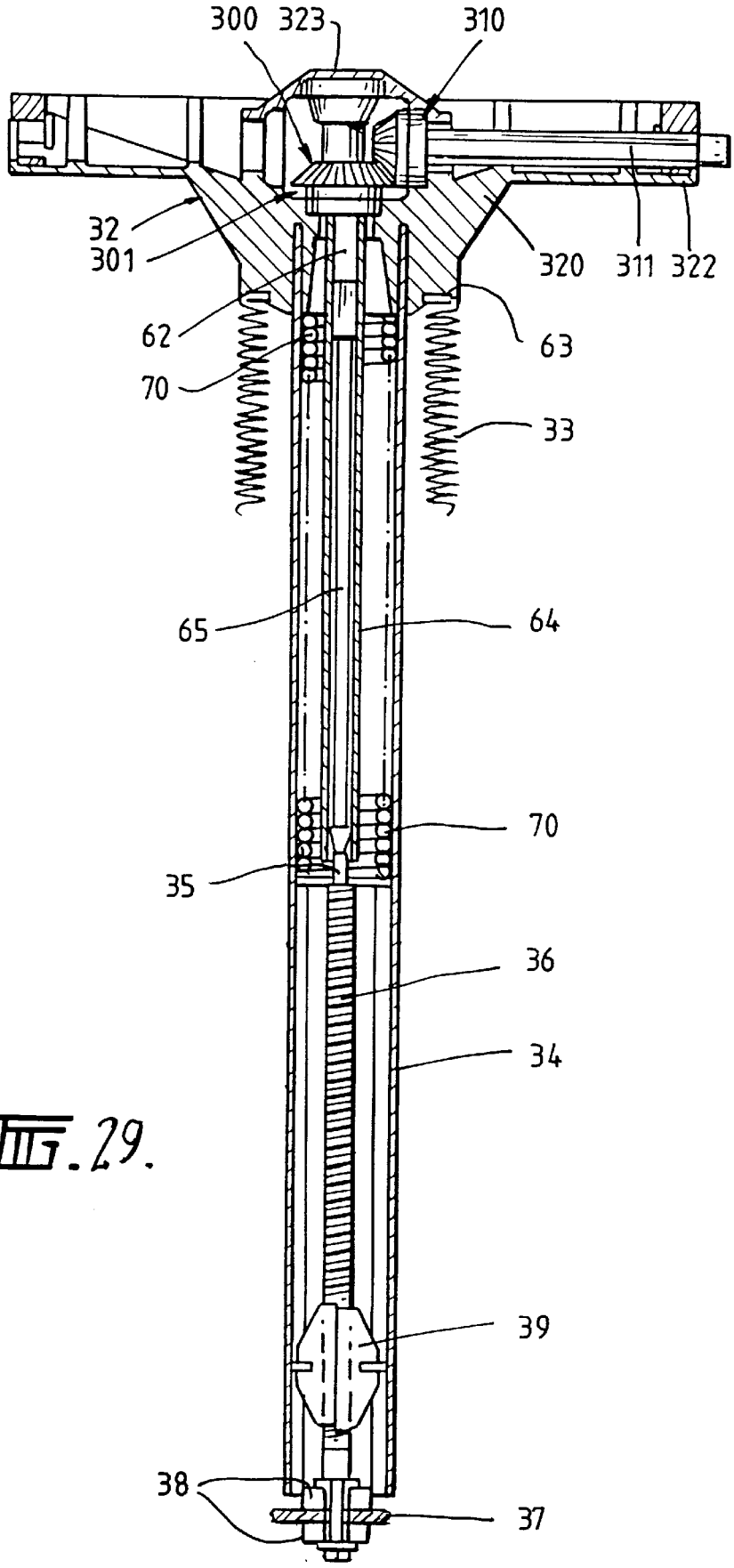
FIG. 29 is a section through the gearbox housing and an internal tube member of the leg which are vertically movable relative to the outer column, base and feet of the leg.

As shown more particularly in FIGS. 18, 27 and 29 a rotatable shaft 35 extends vertically within the steel tube 34 and has an upper portion 64 and a lower portion in the form of a screw 36. The lower end of the screw portion 36 extends through an aperture in a base plate 37 fixed to the column 31 and is received by nuts 38 on the base plate 37. A pair of glass-filled nylon half nuts 39 attached to the internal wall of the steel tube 34 assist in locating the screw 36 within the tube while enabling the screw 36 to rotate to cause the steel tube 34 and gearbox housing 300 to move vertically relative to the column 31 and base plate 37. The glass-filled nylon half nuts 39 provide a generous bearing area and relatively low friction. Vertical movement of the inner steel tube 34 relative to the hollow column 31 is also guided by at least one linear bearing 40 provided between the external surface of the steel tube 34 and the internal surface of the column 31.

The upper portion 65 of the shaft 35 is housed within a tubular member 64 and, as illustrated in FIG. 29, a compression spring 70 may be provided within the steel tube 34 and surrounding the tubular member 65. Such a compression spring 70 can compensate for external loads in the leg 30. The spring 70 is retained between the lower part of the gearbox housing 32 and the base plate 37 in such a manner that it is not rotatable and is fully supported within the steel tube 34 to prevent buckling of the leg column 31.

As shown in FIGS. 1 and 27 a pair of stabilizing feet 41 are attached to the column 31 at its lower end. Each foot 41 is of elongate form having a horizontally extending portion 42 and an upwardly inclined ankle portion 43. The ankle portion 43 is attached to the column 31 by vertically extending flutes 44 received in key apertures in the column 31 and by bolts or screws 45 which extend through a base part 46 of the ankle portion 43 and the base plate 37 to secure the column 31 to the base plate 37. The key effect of the vertically extending flutes 44 eliminates rotation of the feet 41 relative to the column and ensures play-free lateral stability of the top member 10. A plurality of key apertures may be spaced around the circumference of the column 31 to provide different alternative locations for the feet 41.

In a particularly preferred embodiment, the key apertures are provided at 15° increments around the column to permit 24 alternative positions for the feet. Furthermore, for additional stability, it will be appreciated that more than two feet may be attached to the column, for instance, the leg may have three feet extending from the column at 120° relative to each other, or four feet extending at 90° relative to each other.

Figure 28:
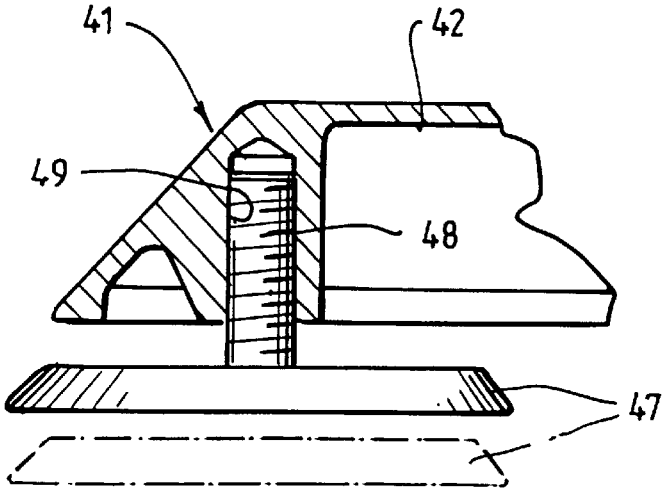
FIG. 28 is a section through a toe part of a foot of the height adjustable leg.

As shown in FIG. 28, at the end of each foot 41 there is provided an adjustable toe pad 47 having a screw-threaded upright rod 48 received in an internally screw-threaded aperture 49 in the foot 41 so that each foot 41 is independently adjustable relative to the floor to allow for unevenness in the floor surface.

Referring more particularly to FIGS. 5 and 6, the gearbox housing 32 for the right-angle gearbox 300 comprises a housing base 320 and a housing cover 323. The housing base 320 has a frusto-conical lower portion 321 and a generally square-shaped upper portion 322. The housing base and cover 320, 323 may be formed from any convenient material, but are preferably formed from cast aluminum. The lower portion 321 of the housing base has an annular recess 324 in its lower surface which receives the upper end of the steel inner tube 34. The housing base 320 may be conveniently secured to the tube 34 by filling the recess 324 around the upper end of the tube with an epoxy resin to form a bonded joint which simulates a collet-type fixing and eliminates free-play, spreading loads to minimize stress concentrations and eliminating interleg bracing.

The upper square-shaped housing portion 322 is provided with four bosses 326, one at each corner, which enable the gearbox housing 32 to be secured to the top member 10, for instance by fixing screws or the like. The bosses 326 are preferably of a self-limiting type so that destructive over-tightening of the attachment screws is substantially avoided to protect the casting from unnecessary internal stresses.

The right-angle gearbox 300 includes a crown gear 301 mounted on the upper end of the vertical shaft 35 so as to be rotatable with the shaft 35 about a substantially vertical axis. The vertical shaft 35 extends through a central opening 325 in the lower housing portion 324 and the crown gear 301 is supported for rotation relative to the lower housing portion 324 by a crown gear bearing race assembly 330.

As shown more particularly in FIGS. 7 to 9 and FIG. 13, the crown gear 301 comprises a central bevelled portion 302 having a plurality of gear teeth 303 thereon, a cylindrical upper shaft portion 304 extending upwardly from the central portion 302 and a stepped lower spigot 305 having an arcuate groove 306 in its external surface disposed between an upper portion 307 of greater diameter adjacent the central portion and a lower portion 308 of lesser diameter at the lower end of the spigot 305.

Figure 7:
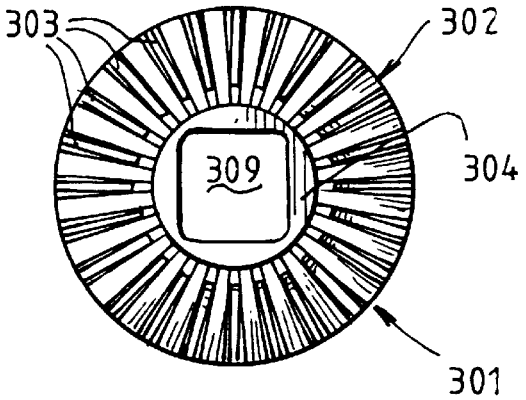
FIG. 7 is a top plan view of the crown gear of the gearbox of FIG. 5.
Figure 8:
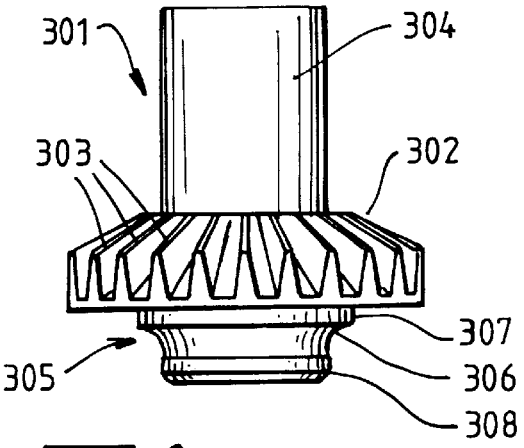
FIG. 8 is a side elevation of the crown gear.
Figure 9:
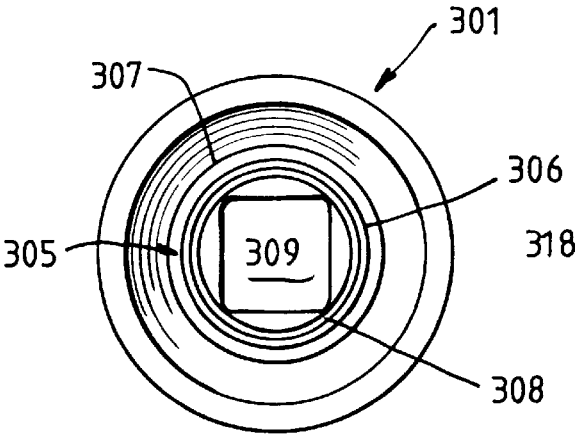
FIG. 9 is an underneath plan view of the crown gear.

The crown gear 301 is of hollow form having a bore 309 of square section extending vertically through the upper portion 304, the central portion 302 and the spigot 305. The square-section bore 309 is adapted to receive an upper shaft extension 62 which is also of square-section for mounting the crown gear 301 on the shaft 35. The crown gear 301 is preferably moulded from plastics material and, as shown in FIGS. 7 to 9, has 24 gear teeth 303 although it will be appreciated that the number of gear teeth may vary for different applications.

The bearing race assembly 330 for the crown gear 301 comprises a plurality of ball bearings 333 and an annular dish-shaped bearing member 332 received in a complementary shaped recess 331 in the surface of the gearbox housing lower portion 321 surrounding the central opening 325. The annular bearing member 332 has a substantially cylindrical outer surface 334 and an internal surface having an arcuate surface section 336 disposed between an cylindrical section 338 of greater internal diameter and a cylindrical section 339 of lesser internal diameter. The ball bearings 333 are therefore received in a bearing race between the arcuate surfaces 305 and 336.

Figures 13, 14, 15, 16, 17:
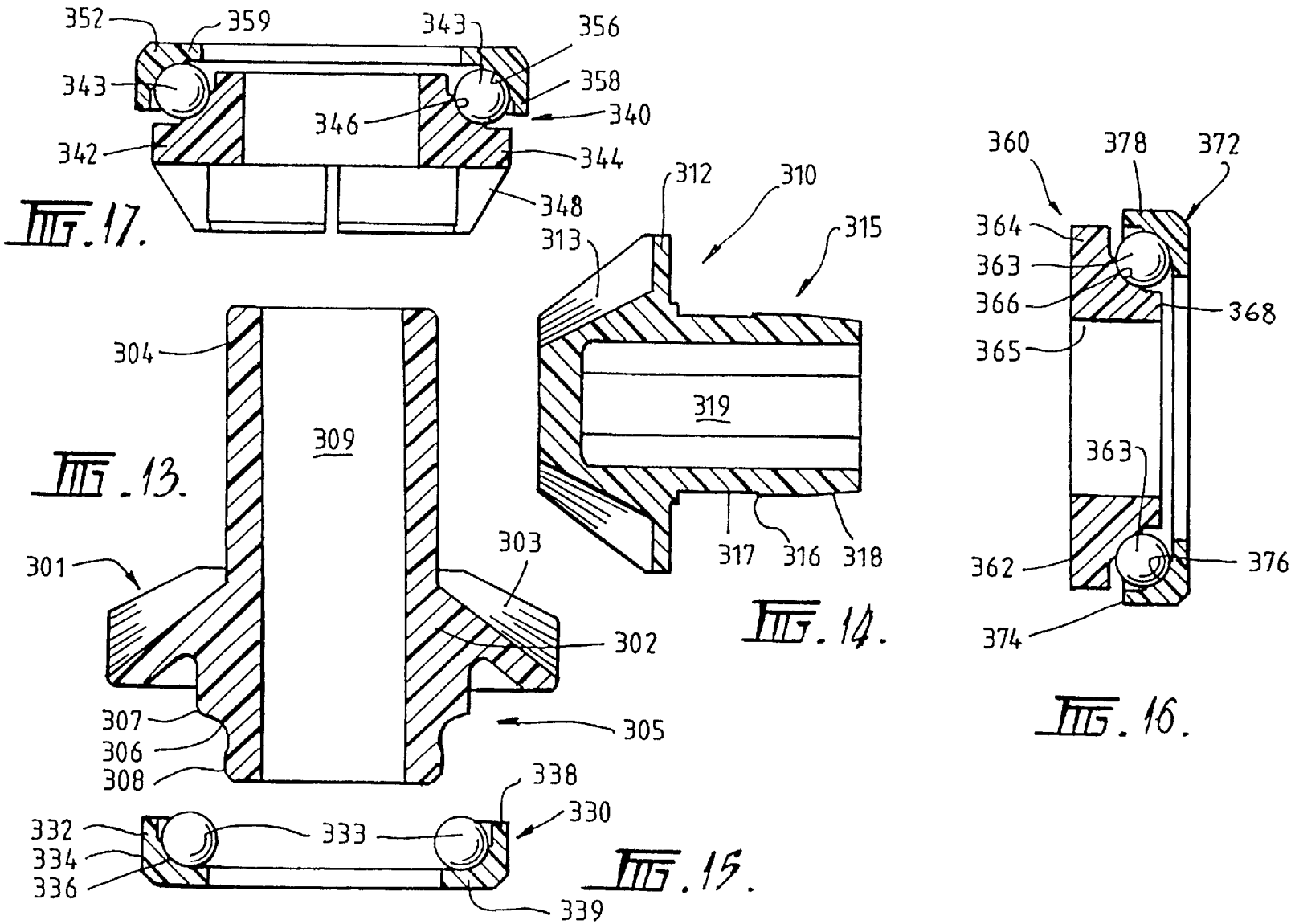
FIG. 13 is an enlarged section through the crown gear.
FIG. 14 is an enlarged section through the pinion gear.
FIG. 15 is an enlarged section through a bearing race between the crown gear and the gearbox housing.
FIG. 16 is an enlarged section through a bearing race adapted to be mounted on the pinion gear.
FIG. 17 is an enlarged section through a bearing race between the gearbox and the gearbox cover.

An upper bearing race assembly 340 similar to the bearing race assembly 330 is provided between the upper end of the shaft portion 304 of the crown gear 301 and the gearbox housing cap 323. The upper bearing race assembly 340 comprises a plurality of ball bearings 343 received in a ball race provided between a first annular bearing race member 342 and a second annular bearing race member 352. Referring more particularly to FIG. 17 the first bearing race member 342 is of annular form having an upper annular portion 344 of smaller internal diameter providing an upwardly and outwardly facing arcuate bearing surface 346 and a lower splined portion 348 of greater internal diameter adapted to fit over and be secured to the upper end of the shaft portion 304 of the crown gear 301. The second bearing race member 352 is of similar form to the annular bearing member 332 and has an arcuate surface section 356 disposed between a cylindrical section 358 of greater internal diameter and a cylindrical section 359 of lesser internal diameter. In use, the second bearing race member 352 is received in a complementary dish-shaped recess 351 in the lower surface of the gearbox housing cap 323 so that the arcuate surface 356 faces downwardly and inwardly with the ball bearings 343 being received in a bearing race between the arcuate surfaces 346 and 356.

The gearbox 300 also includes at least one pinion gear 310 engageable with the crown gear 301 and mounted on the end of a rotatable horizontal shaft 311 which extends in a horizontal direction out of the gearbox housing 32. The horizontal shaft 311 is conveniently of hexagonal section and is rotatably supported by a bush 328 at the side of the upper housing portion 322. As shown in FIG. 6, up to four horizontal shafts 311 each carrying a pinion gear 310 engageable with the crown gear 301 may be provided, but only one shaft 311 and pinion gear is illustrated in FIG. 5.

As shown more particularly in FIGS. 10 to 12 and 14, the pinion gear 310 comprises a bevelled portion 312 having a plurality of gear teeth 313 thereon and a stepped spigot 315 having an internal bore 319 of hexagonal section adapted to receive an end of the hexagonal horizontal shaft 311 for mounting the pinion gear 310 on the shaft 311. The spigot 315 has a stepped shoulder 316 disposed between a cylindrical portion 317 adjacent the bevelled portion 312 and the wider end of a slightly frusto-conical portion 318. The cylindrical portion 317 is adapted to receive a bearing race member 361 of a pinion gear bearing race assembly 360 as illustrated in FIG. 16.

Figure 10:
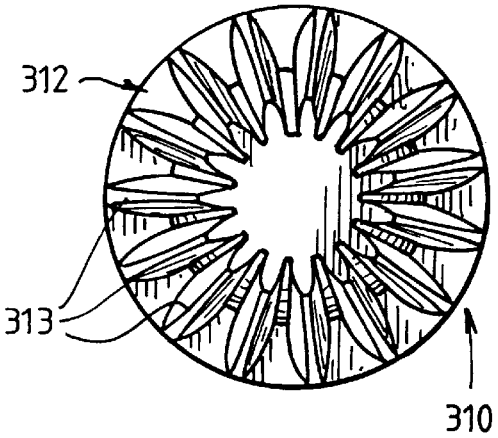
FIG. 10 is a front elevation of a pinion gear of the gearbox of FIG. 5.
Figure 11:
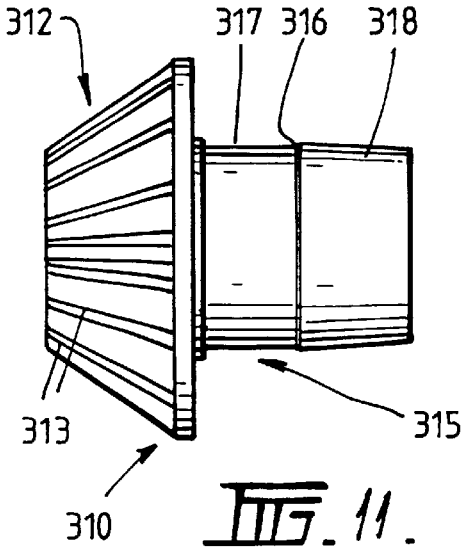
FIG. 11 is a side elevation of the pinion gear of FIG. 10.
Figure 12:
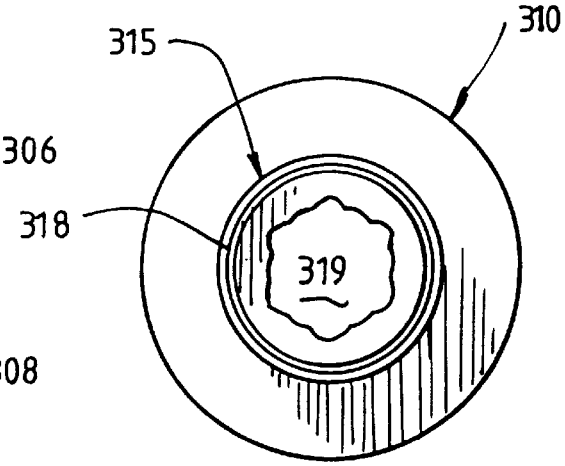
FIG. 12 is a rear elevation of the pinion gear.

The pinion gear 310 may also be conveniently formed as a plastics moulding and, as shown in FIGS. 10 to 12, has fifteen gear teeth 313 although it will be appreciated that the number of gear teeth may vary for different applications.

Referring more particularly to FIG. 16, the bearing race assembly 360 for the pinion gear 310 comprises a plurality of ball bearings 363 in a ball race provided between first and second annular bearing race members 362 and 372. The first bearing race member 362 is of annular form having a cylindrical bore 365 of an internal diameter corresponding to the external diameter of the cylindrical portion 317 of the spigot 315. The external surface of the bearing race member 362 has an arcuate surface section 366 disposed between a cylindrical section 364 of greater external diameter and cylindrical section 368 of lesser external diameter. The second annular bearing race member 372 is similar form to the bearing race members 332 and 352 having a substantially cylindrical outer surface 374 and an internal surface including an arcuate surface section 376 between a cylindrical section 378 of greater internal diameter and a section of lesser internal diameter 379.

In use, the bearing race member 362 is secured on the cylindrical portion 317 of the pinion gear 310 and the bearing race member 372 is received in a dish-shaped recess around the spigot 315 of the pinion gear 310 provided by a part-circular recess 361 in the housing base 321 and by a part-circular recess 371 in the housing cap 323. The cap 323 of the gearbox housing 32 is secured to the housing base 321, for instance by fixing screws received in screw holes 327 in the base 321, and therefore retains the bearing race assemblies 350 and 370 securely in the gearbox housing 32.

The crown and pinion gears 301, 310, and the bearing race members 332, 342, 352, 362, 372 of the bearing race assemblies 330, 340 and 360 are conveniently moulded from a low friction plastics material, such as an acetyl resin, nylon, PTFE or the like, so as to provide low friction bearings for the crown and pinion gears 301 and 310. This is particularly advantageous in a height adjustment system such as illustrated in FIGS. 3 and 4 in which a single drive mechanism 50 is used to adjust the height of a plurality of legs simultaneously.

As shown in FIGS. 3 and 4, the drive mechanism 50 comprises a winding mechanism including a rotatable drive shaft 51 linked by universal joints 52 and 53 and a first rotatable transmission member 54 to a driven shaft 55. The driven shaft 55 is connected to the rotatable drive transmission member 21, e.g. by a right-angle drive gearbox 58, in such a manner as to rotate the transmission member 21 when the winding mechanism is operated. A retractable handle 56 is connected by a universal joint 57 to the drive shaft 51 for manual operation of the winding mechanism, but it will be appreciated that different types of drive mechanisms, for instance a drive mechanism including an electric motor drive, may be provided instead of a manually operable winding mechanism.

When the drive mechanism 50 is operated, the drive transmission member 21 and the horizontal shafts 211, 311 are caused to rotate and the gearboxes 200, 300 in turn cause the vertical screw shafts 35 of the respective legs 30 and 30 to rotate so that the height of those legs which support the desk- or work-top member 10 are adjusted simultaneously. Since the gearbox 200 includes another pinion gear and associated horizontal shaft 211', the drive transmission member 22 and the shaft 311' are also caused to rotate and the height of leg 30' is also adjusted by means of the gearbox 300'.

A further advantageous feature of the height adjustment system of the invention is that the legs 30 include self-adjusting linear bearings 40 which will be described with particular reference to FIGS. 18 to 26.

The linear bearings 40 for the height adjustable legs 30 each comprise a bearing body 400 located between the relatively movable inner steel tube 34 and the outer hollow column 31 of the leg 30, a pair of upper and lower hollow wedge members 410, 420 and an elongate member spoke 430 extending through and connecting the wedge members 410, 420.

The bearing body 400 is preferably formed from a low friction plastics material, such as nylon, and has wider upper and lower bearing regions 401 and 402 and a narrower central region 403.

The bearing body 400 is secured to the upper end of the column 31, for instance by fixing bolts or screws 406, and the outer surfaces 404 of the wider upper and lower regions 401 and 402 engage with the internal surface of the column 31. The internal surfaces 407 of the upper and lower regions 401 and 402 are arranged to provide bearing surfaces for the external surface of the inner steel tube 34 so as to allow the tube 34 to move vertically relative to the column 31.

The upper and lower regions 401 and 402 each have at least one vertically extending tapered rectangular aperture 408 for receiving a respective one of the wedge members 410, 420 which are provided for expanding the upper and lower regions 401, 402 when adjustment for wear is required.

The upper wedge member 410 is of tapered rectangular section having a wider upper end 411, a narrower lower end 412 and a vertical bore 413 extending through the wedge member 410. The lower wedge member 420 is of similar form having a wider lower end 421, a narrower upper end 422 and a vertical bore 423 extending through the wedge member 420. Each wedge member 410, 420 is arranged to taper outwardly from its narrower end 412, 422 to its wider end 411, 421 at an angle which is less than the friction angle of the material from which the wedge members are formed.

The wedge members 410, 420 may be formed from any convenient material, but are preferably formed from a low-friction plastics material such as nylon or polyethylene. In a preferred embodiment the wedge members 410, 420 taper at an angle of about 6.5° to the vertical, which is substantially less than the friction angle for nylon of about 21°.

The elongate spoke member 430 extends into and is secured to the lower wedge member 420 preferably by providing a threaded portion 431 at the lower end of the spoke member 430 which acts as a self-tapping screw. The spoke member 430 extends upwardly through the bore 413 in the upper wedge member 410 in such a manner that the upper wedge member 410 is moveable relative to the spoke member 430. A spoke nut 432 is provided on the upper end of the spoke member 430 and a spring 433 is provided between the spoke nut 432 and the wider upper end 411 of the upper wedge member 410 to urge the upper wedge member 410 downwardly into the aperture 408 in the upper region 401 of the bearing body 400.

Figure 21:
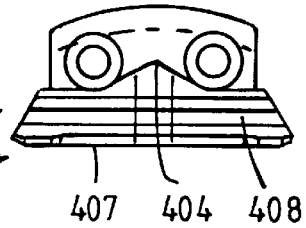
FIG. 21 is a plan view of the bearing body.
Figure 20:
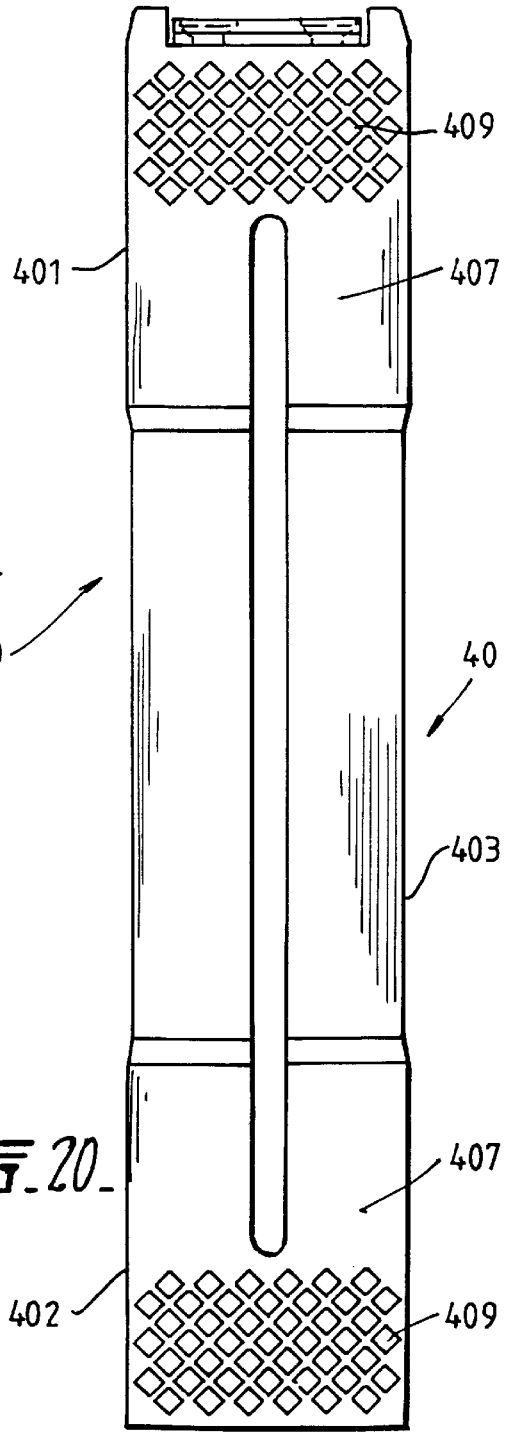
FIG. 20 is an opposite side view of the bearing body for the linear bearing assembly of FIG. 19.
Figure 22:
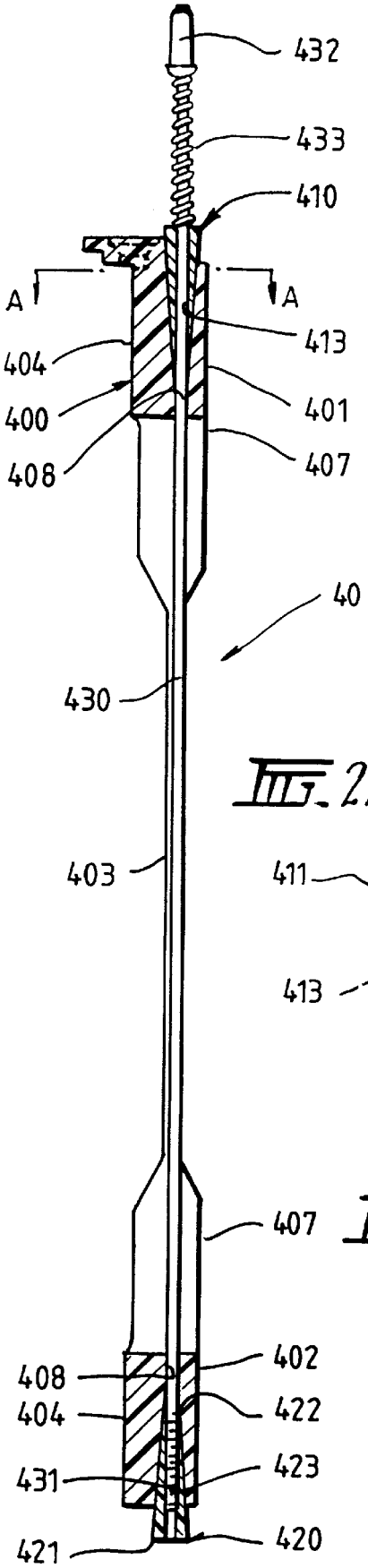
FIG. 22 is a vertical section through the linear bearing assembly.
Figure 23:
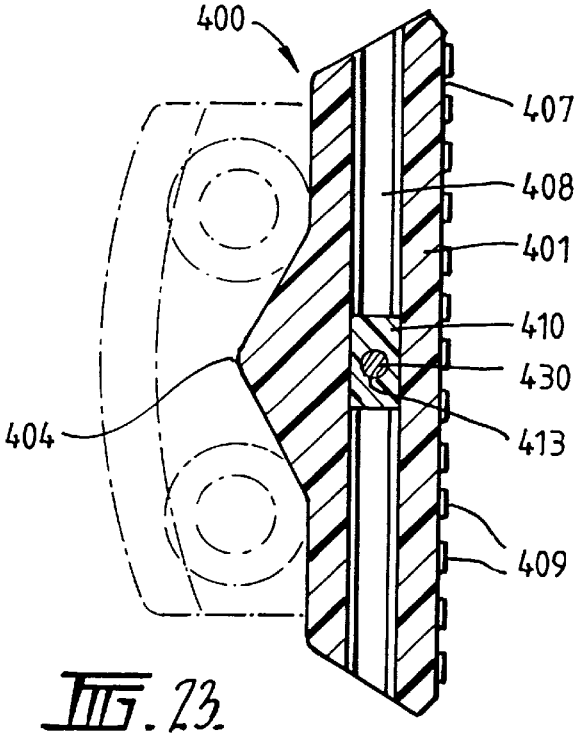
FIG. 23 is a section on the line A—A of FIG. 22.
Figure 24:
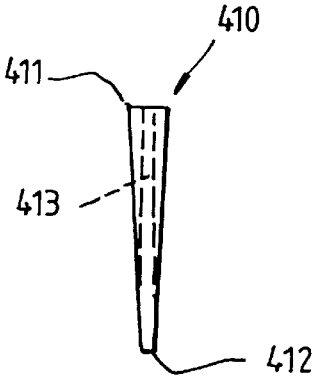
FIG. 24 is an end view of a wedge member for the linear bearing assembly.
Figure 25:
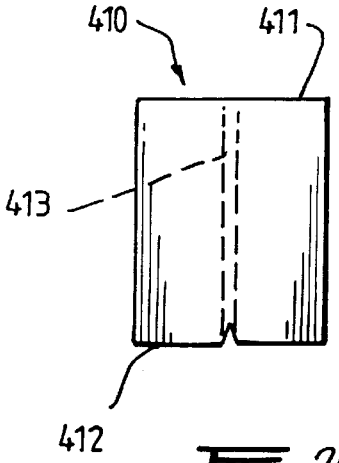
FIG. 25 is a side view of the wedge member of FIG. 24.
Figure 26:
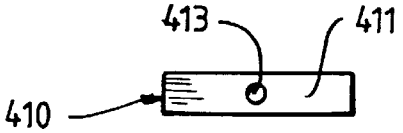
FIG. 26 is a plan view of the wedge member.

Whilst only one linear bearing 40 is specifically illustrated in FIG. 18, it will be appreciated that a plurality of circumferentially spaced bearings 40 may be conveniently provided between the inner tube 34 and the outer column 31 of the leg. As shown in FIG. 21, the internal surfaces 407 of the upper and lower regions 401, 402 of the bearing body 401 are generally planar surfaces adapted to provide bearing surfaces for an inner tube member 34 having flat outer surfaces, such as an inner tube member of square-section. It will, however, be appreciated that the shape of the bearing surfaces may be varied to suit inner tube members of different shapes. For instance, at least one bearing body with arcuate bearing surfaces may be provided for a cylindrical inner tube member. As shown in FIG. 20, each bearing surfaces 407 may be provided with a tread pattern of diamonds 409 raised between 0.1 and 0.25 mm from the remainder of the bearing surface 407 to provide a longer lasting bearing surface.

In use, the linear bearings 40 provide only a light static preload between the telescopically movable inner tube member 34 and the outer column 31 and therefore allow an easy linear motion between those parts. They are also fully self-adjusting to ensure that no free-play between the inner and outer members 34 and 31 occurs as the bearing surfaces 407 wear. Adjustment is achieved automatically because as the bearing surfaces 407 wear the upper wedge member 410 moves downwardly under the influence of the spring 433 to expand the upper region 401 of the bearing body 400 and the spring 433 also causes the lower wedge member 420 to move upwardly to expand the lower region 402 of the bearing body 400. Since the angle of the wedges is below the friction angle for the material of the bearing body, the wedges are prevented from being ejected from the bearing body under the effect of externally applied loads and the wedges also prevent excessive generation of preloads across the main bearing surfaces. The rigid link provided by the spoke 430 also permits easy assembly and disassembly of the lower wedge 420 and lower region 402 of the bearing body 400.

The self-adjusting bearing assembly of the invention therefore provides automatic compensation for wear ensuring smooth operation and long service life for the height adjustable leg.

Referring to FIGS. 30 to 55 of the drawings there is shown a modified embodiment of a desk height adjustment system incorporating further advantageous features of the invention.

Figure 30:
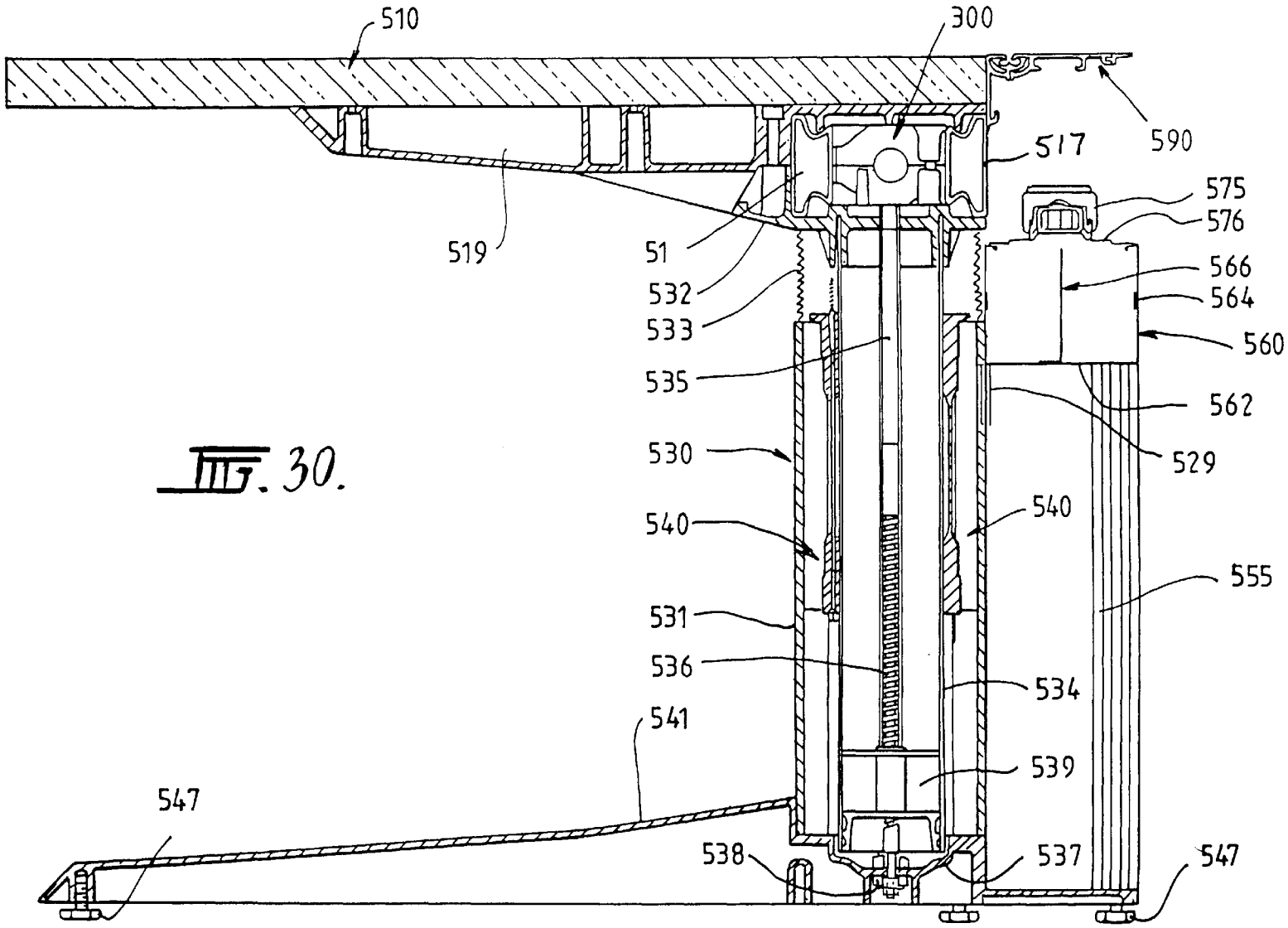
FIG. 30 is a section through a modified height adjustable leg in accordance with the invention.
Figure 31:
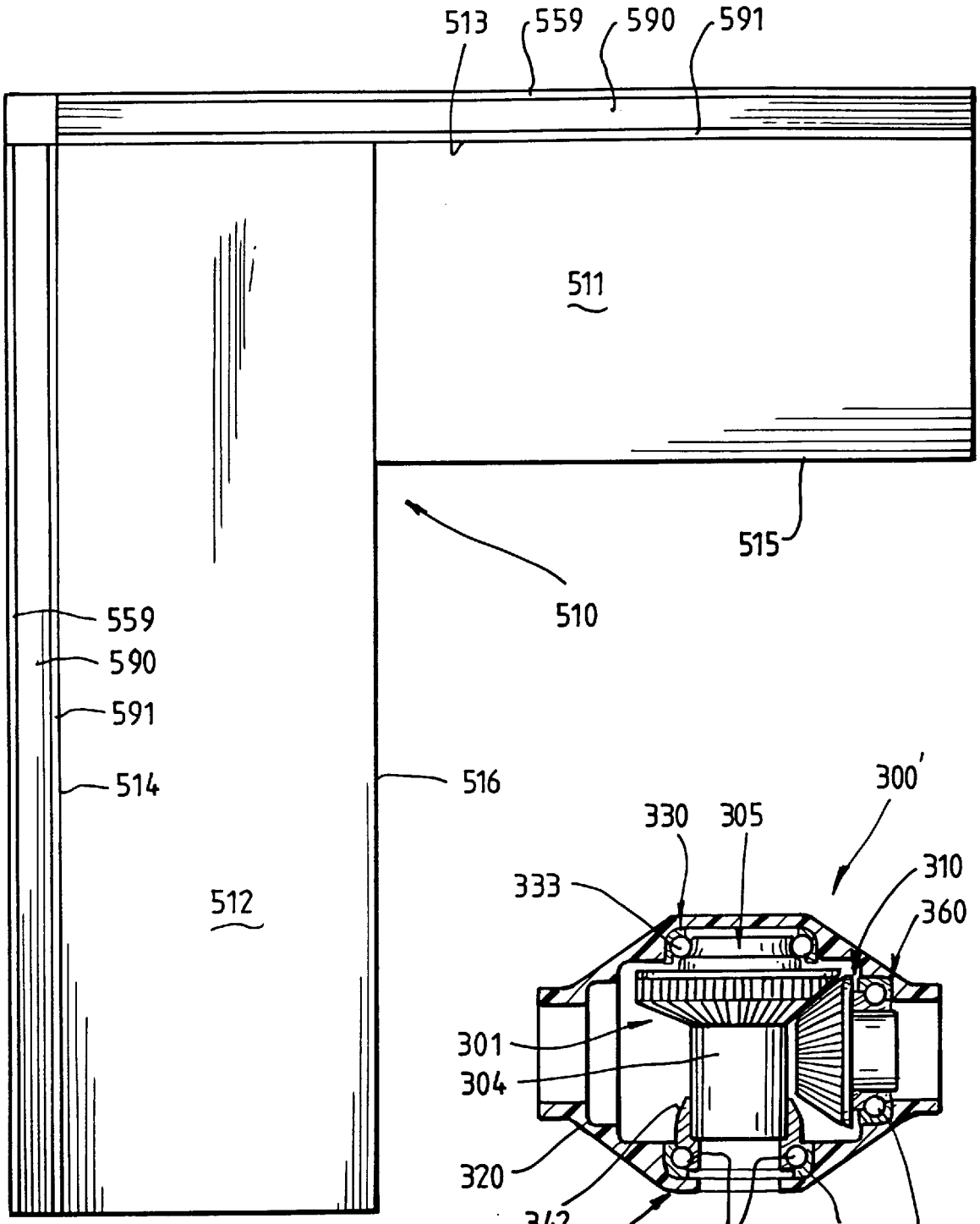
FIG. 31 is a top plan view of a desk including a plurality of height adjustable legs of the kind shown in FIG. 30.
Figure 32:
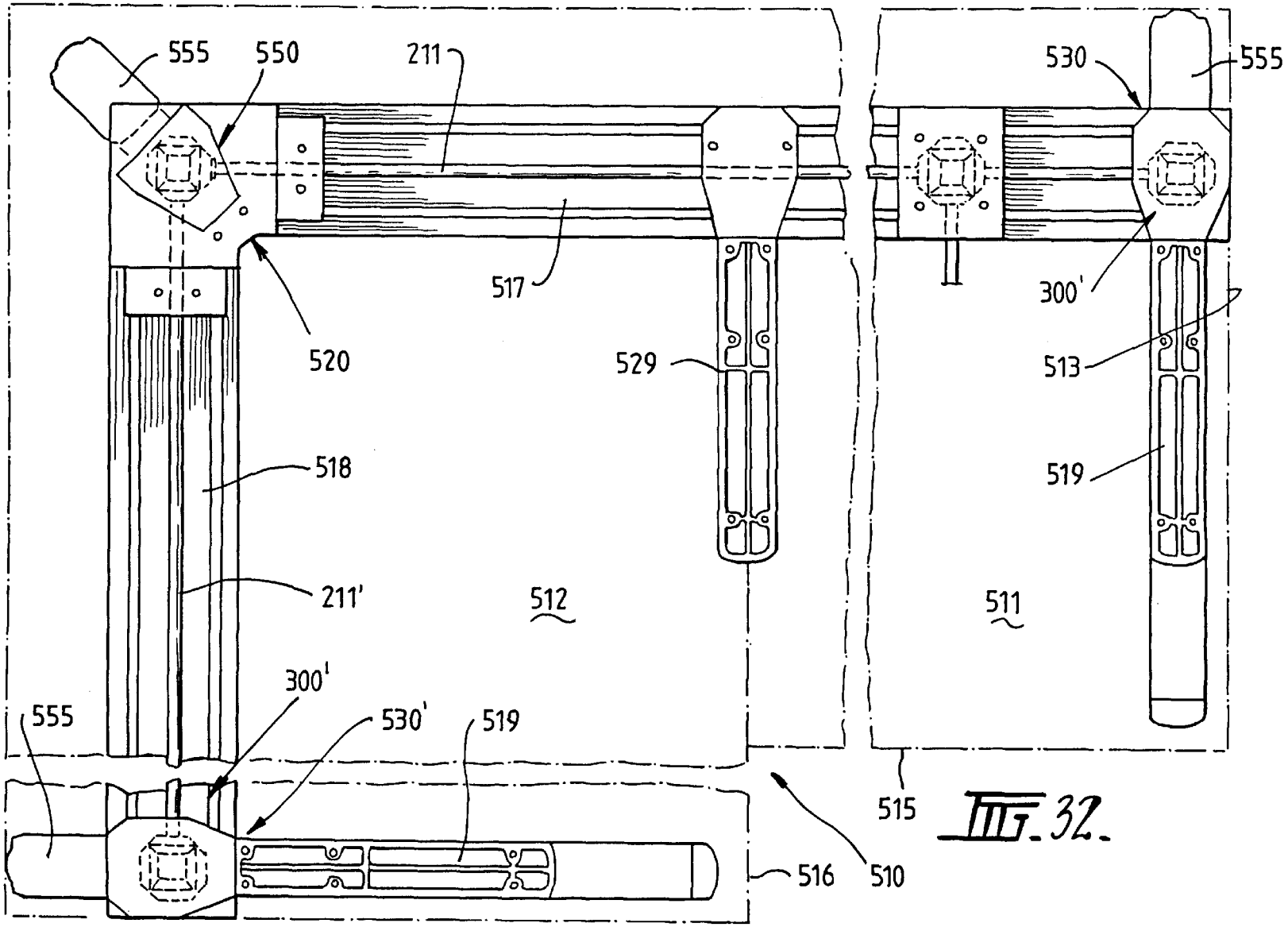
FIG. 32 is a top plan view of the desk of FIG. 31 with the desk top shown in broken lines.

As shown in FIGS. 31 and 32 a substantially L-shaped desk-top member 510 has first and second limbs 511 and 512 and is supported by height adjustable legs 530 and 530' at the ends of the limbs, and by another height adjustable leg 520 at the corner of the L-shaped desk top member 510. The desk height adjustment system as shown in FIGS. 30 to 32 differs from that shown in FIGS. 1 to 3 in that the height adjustable legs 520, 530 and 530' are disposed adjacent to rear or outer edges 513, 514 of the limbs 511, 512 of the desk top member 510 instead of at positions midway between the rear or outer edges 513, 514 and the front or inner edges 515, 516 of the limbs as the embodiment of FIG. 3. This is achieved by the use of roll-formed steel beams 517, 518 extending between the legs 520, 530, 530' and cantilever support arms 519 mounted on and extending substantially horizontally and generally perpendicularly to the beams 517, 518 at the rear or outer edges 513, 514 of the limbs 511, 512 of the desk top member 510. The cantilever support arms preferably extend from the upper ends of the legs 530, 530' and, if required, at least one additional cantilever support arm 529 may be provided at a position or positions between the corner leg 520 and the legs 530, 530'.

Referring to FIG. 30 and FIGS. 48 to 52, the upper leg part 532 comprises a metal plate casting 620 having a main body portion 621 and a forward extension portion 622. The main body portion 621 and forward extension portion 622 each have tubular bolt-receiving portions 623 and 624 extending upwardly from the upper surface of the plate adapted to receive bolts 625 for fixing the upper leg part to a cantilever support arm 519. The cantilever support arm 519 is of elongate form having a main body portion 190 mounted on the support beams 517, 518 and an elongate arm portion 192 extending in a substantially horizontal direction from the main body portion 190. The body portion 190 of the support arm 519 is provided with complementary tubular bolt-receiving formations 628, 629 with apertures extending therethrough for receiving the fixing bolts 625. The support arm 519 is also provided with holes 194 in both the body portion 190 and arm portion 192 which receive screws 196 for securing the support arm 519 to the desk-top member 510. The support beams 517, 518 are disposed between the main body portion 621 of the upper leg part 622 and the support arm 519 so as to be clamped therebetween. The main body portion 621 of upper leg part 532 is also provided with a plurality of screw-receiving apertures 626 and a larger central opening 627 extending through the plate casting 620.

Figure 48:
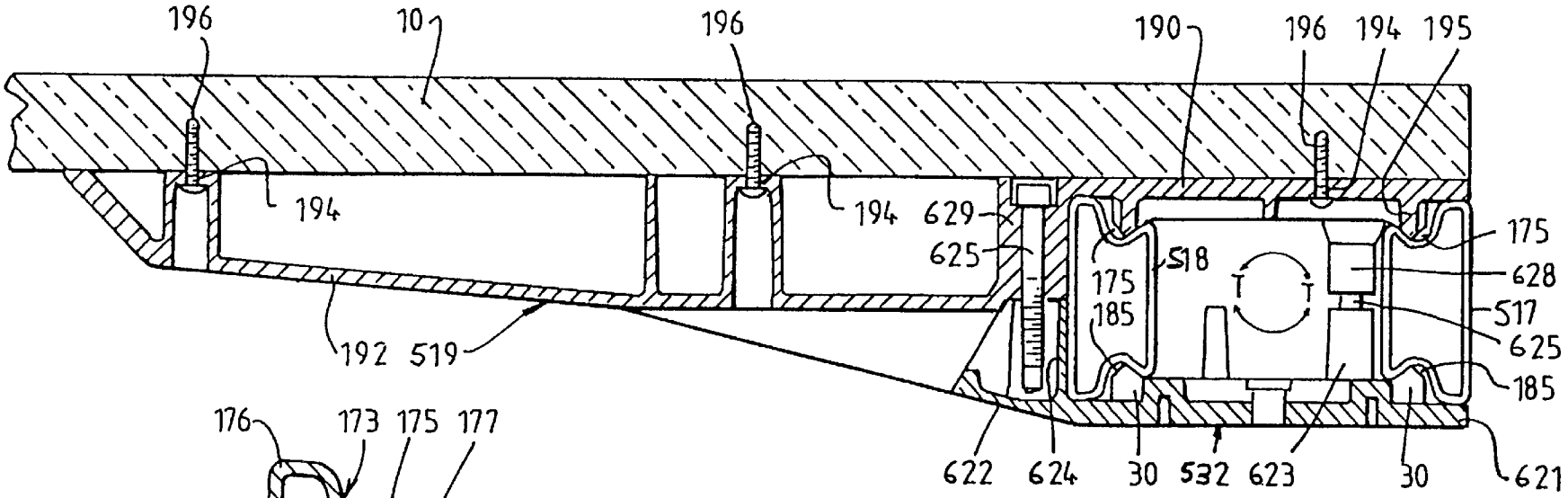
FIG. 48 is an enlarged section through the work-top and support arrangement for the desk of FIG. 30.
Figure 49:
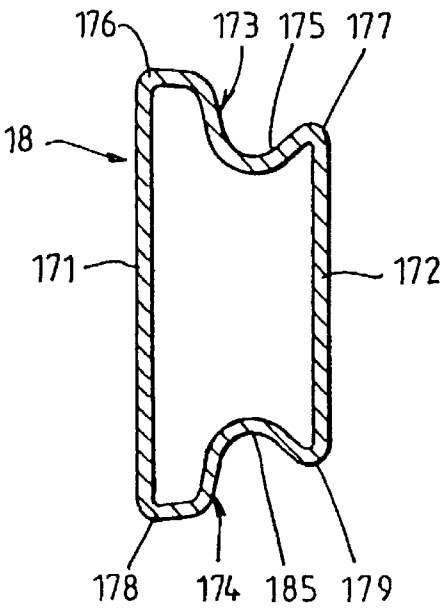
FIG. 49 is an enlarged section through one of the support beams for the work-top.
Figure 50:
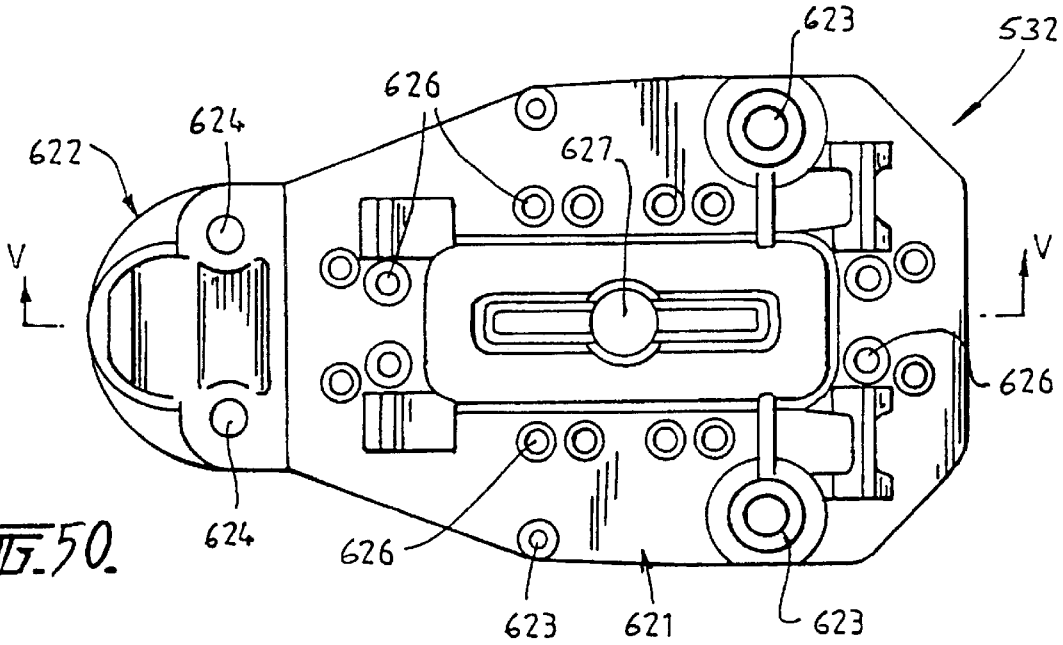
FIG. 50 is a top plan view of an upper leg part of the desk of FIG. 30.
Figure 51:
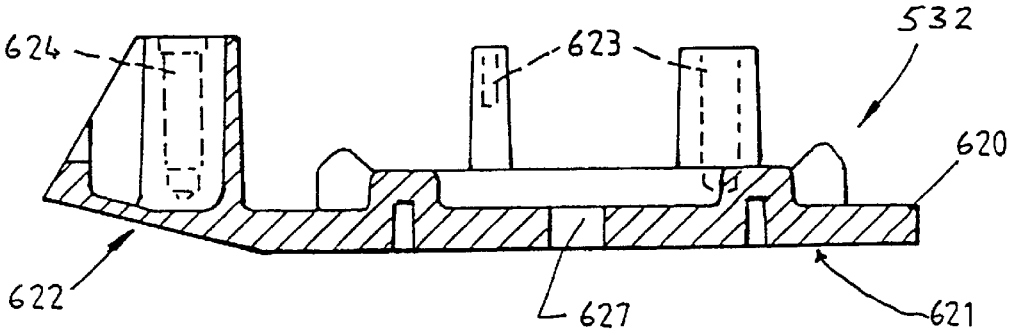
FIG. 51 is a section on the line V—V of FIG. 50.
Figure 52:
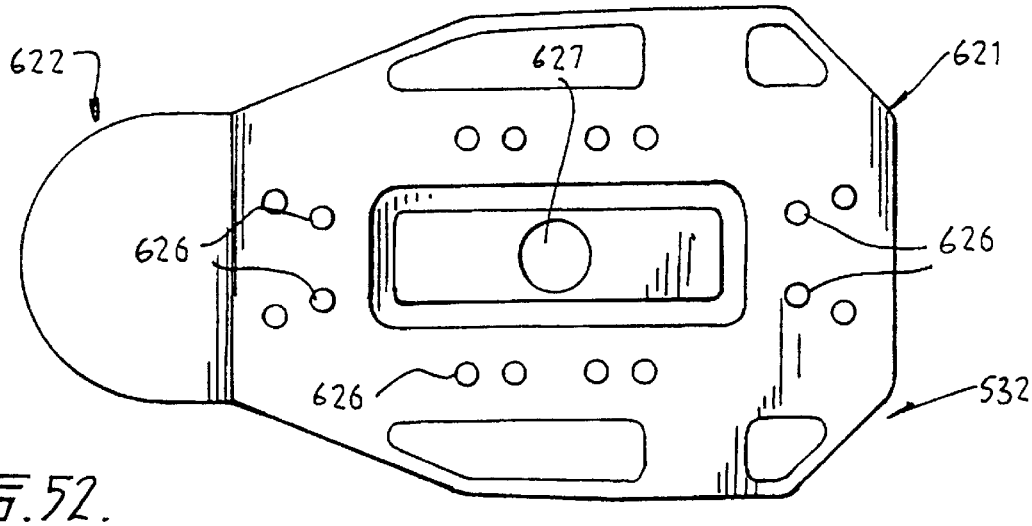
FIG. 52 is an underneath plan view of the upper leg part of FIG. 50.

Referring more particularly to FIGS. 48 and 49, each pair of support beams comprises an outer support beam 517 and an inner support beam 518. The support beams 517, 518 of each pair are disposed at substantially the same horizontal level and extend substantially parallel to each other between adjacent legs 20, 20' of the desk. Each support beam 517, 518 is of hollow form and is preferably made from roll-formed steel. Each support beam 517, 518 has substantially parallel straight sides, 171, 172 which extend substantially vertically in use and upper and lower end portions 173, 174 joining the sides 171, 172.

The upper end portion 173 of each beam 517, 518 is of curved form having a rounded depression 175 between the upper ends 176, 177 of the sides 172, 172, of the beam. The lower end portion 174 of each beam is similarly of curved form having a rounded recess 185 between the lower ends 178, 179 of the sides 172, 172 of the beam. One of the sides 171 of each beam is longer than its opposite side 172 and the beams 517, 518 are spaced apart with their shorter sides 172 facing towards one another.

As shown in FIG. 48, the lower surface of the body portion 190 of the support arm 19 has downwardly extending projections 195 which engage in the depressions 175 in the upper end portions 173 of the support beams 517, 518. Similarly the upper surface of the body portion 621 of the upper leg part 532 has upwardly extending projections 630 which are received in the recesses 185 in the lower end portions 174 of the support beams 517, 518.

The provision of two spaced apart rolled steel support beams 517, 518 which are securely clamped together between the body portions 190, 621 of the support arm 519 and of the upper leg part 532 by the fixing bolts 625 provides a strong cantilever support for the work-top 10 secured to the support arm 19. The engagement of the projections 195, 630 of the support arm 19 and upper leg part 22 in the depressions 175 and recesses 185 of the support beams 517, 518 assist in keeping torsional forces (which would normally be exerted on the support arrangement in the direction T shown in FIG. 48) to a minimum.

Whilst the cantilever support arms 519 assist in providing support for the work-top 10, the arrangement of the spaced apart support beams can provide sufficient cantilever support for a desk or work-top without requiring cantilever support arms extending in a horizontal direction from the support beams, as will be described with reference to the modified clamping arrangement at FIGS. 53 to 55 of the drawings.

Figure 53:
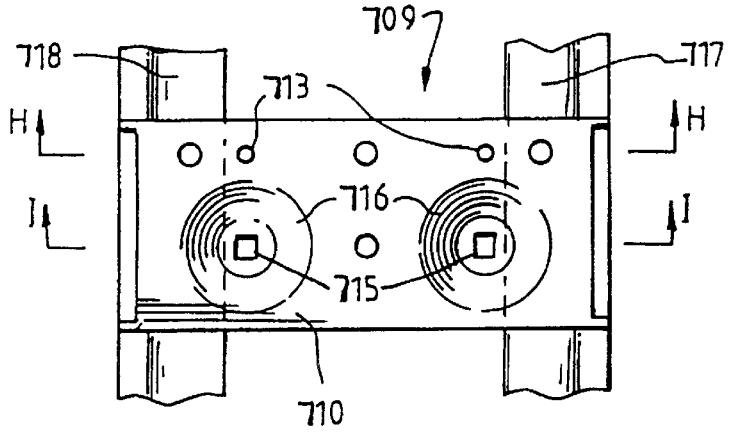
FIG. 53 is a plan view of a modified support arrangement for the work-top.
Figure 54:
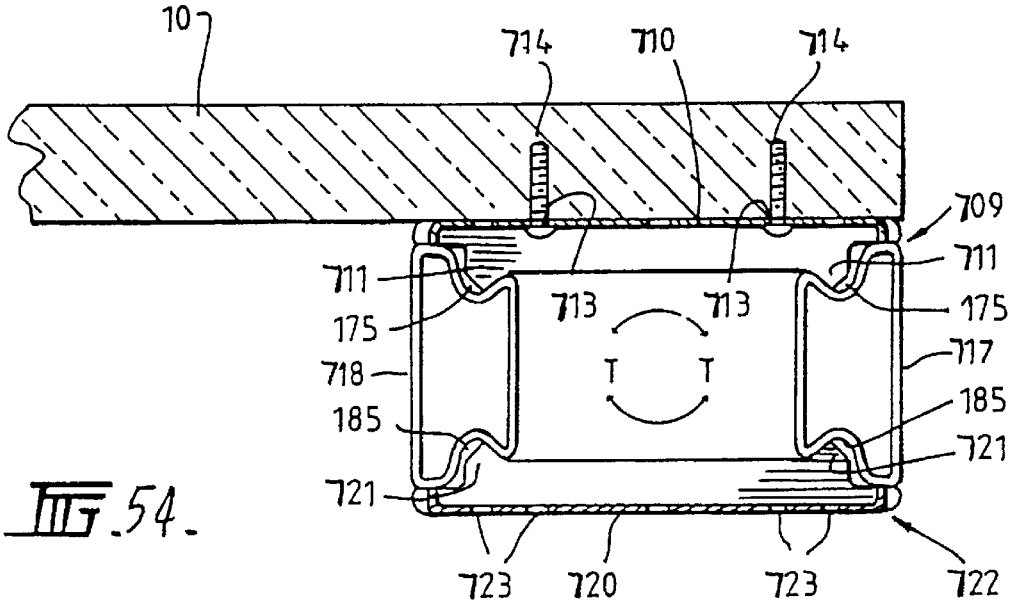
FIG. 54 is a section on the line E—E of FIG. 53.
Figure 55:
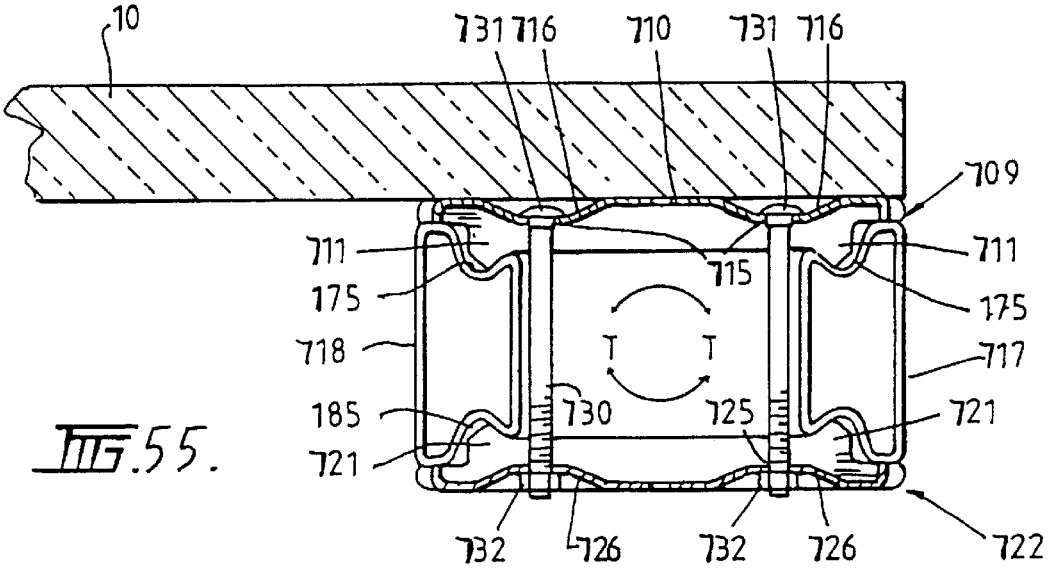
FIG. 55 is a section on the line F—F of FIG. 53.

In the modified clamping arrangement of FIGS. 53 to 55, the spaced apart support beams 717 and 718 are of identical form to the support beams 517 and 518 of FIGS. 48 and 49 and corresponding reference numerals have been applied to corresponding parts. The support beams 717 and 718 are clamped between upper and lower clamping members 709 and 722 which are of similar form to each other. The upper clamping member 709 comprises a clamping plate 710 having projections 711 extending downwardly from its lower surface which engage in depressions 175 in upper end portions 173 of the support beams 717, 718. The clamping plate 710 has a plurality of screw holes 713 which receive screws 714 for securing the work-top member 10 to the upper clamping member 709. The clamping plate 710 also has a pair of bolt-receiving holes 715 spaced apart on the central longitudinal axis of the clamping plate 710.

The lower clamping member 722 comprises a clamping plate 720 of similar form to the clamping plate 710 and has projections 721 extending upwardly from its lower surface which engage in the recesses 185 in the lower end portions 174 of the support beams 717, 718.

The lower clamping member 722 also has a pair of bolt-receiving holes 725 extending through the plate 720 at spaced apart locations on the central longitudinal axis of the plate 720. When the lower clamping member 722 is to be secured to the upper end of a supporting leg from the work-top 10, the clamping plate 720 will also be provided with a plurality of bolt or screw holes 723 for receiving bolts or screws for securing the lower clamping member 722 to the upper end of a leg.

As shown in FIGS. 54 and 55, the spaced apart support beams 717, 718 are clamped between the upper and lower clamping members 709, 722 by coach bolts 730 extending through the bolt-receiving holes 715 and 725 in the clamping plates 710, 720. The upper and lower clamping plates 710, 720 preferably have recessed areas 716, 726 surrounding the bolt-receiving holes which are engaged respectively by heads 731 of the bolts 730 and nuts 732 received on the lower end of the bolts 730.

The spaced apart support beams 717, 718 which are securely clamped together between the upper and lower clamping members 109, 122 by the bolts 130 provide a strong cantilever support for the work-top 10 which does not necessarily require cantilever support arms extending horizontally from the support beams. Also, as in the arrangement of FIGS. 48 to 53, the engagement of the projections 711 and 721 of the clamping members 709, 722 in the depressions 775 and recesses 785 of the support beams 717, 718 assists in keeping torsional forces T to a minimum.

Figure 47:
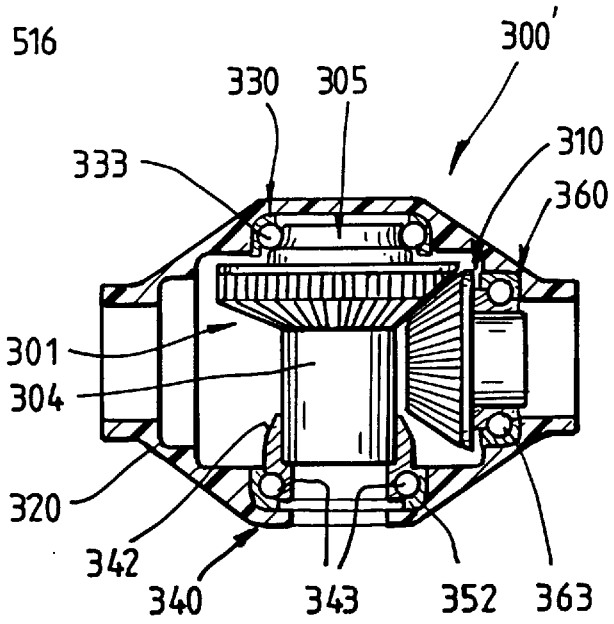
FIG. 47 is a section through an alternative form of gearbox assembly.

In similar manner to the desk height adjustment system shown in FIG. 32, each of the height adjustable legs 520, 530, 53' incorporates a right angle gearbox 300' at its upper end, with rotatable shafts 211, 211' extending therebetween, and a drive mechanism including a further right angle gearbox 550 is provided for adjusting the height of the legs simultaneously. The right-angle gearbox 300' may be of similar form to the right angle gearbox 300 described with reference to FIGS. 5 to 17, or an alternative form of gearbox as shown in FIG. 47 may be used in which the crown gear 301 is mounted on the upper end of the vertical shaft 535 between the top cover 323 of the gearbox housing 532 and the pinion gear or gears 310. The same components may be used in the respective gear box assemblies 300 and 300', with the bearing assembly formed by bearing race members 342 and 352 and bearings 343 being disposed between the base 320 of the gearbox housing and the shaft portion 304 and the bearing race assembly 330 being provided between the cover 323 and the crown gear.

One of the height adjustable legs 530 is shown in FIG. 30. The height adjustable leg is similar to that of FIG. 1 in that the leg 530 has a first leg part in the form of a hollow cylindrical upright column 531 and a relatively movable second leg part in the form of an inner tubular member 34 secured to an upper leg part 532 for the right-angle gear box at the upper end of the leg 30 on which the gearbox is provided.

The upper end of the column 531 is connected to the upper end part 532 by an expandable bellows member or shroud 533 which allows the gearbox housing 300 to move in a vertical direction relative to the column 31.

The rotatable shaft 535 extends vertically within the tubular member 534 and has a lower portion in the form of a screw 536. The lower end of the screw portion 536 extends through an aperture in the base 537 of a foot 541 fixed to the column 531 and is received by nuts 538 on the base 37. A pair of glass-filled nylon half nuts 539 attached to the internal wall of the tubular member 534 assist in locating the screw 536 within the tube while enabling the screw 536 to rotate to cause the tubular member and upper housing part 532 to move vertically relative to the column 531 and foot 541. The glass-filled nylon half nuts 539 provide a generous bearing area and relatively low friction. Vertical movement of the inner tubular member 34 relative to the column 31 is also guided by at least one self-adjusting linear bearing 540 provided between the external surface of the tube 534 and the internal surface of the column 531. The linear bearing is substantially as described with reference to FIGS. 18 to 26 of the drawings.

An adjustable toe pad 547 having a screw-threaded upright rod received in an internally threaded aperture is provided at each end of the foot 541 so that the level of the foot 541 can be adjusted relative to the floor.

In accordance with a further advantageous feature of the invention, the desk height adjustment system is provided with a cable duct and tray system as will now be described with reference to FIGS. 30 and 33 to 46.

Figures 33, 34, 35, 36, 37, 38, 39:
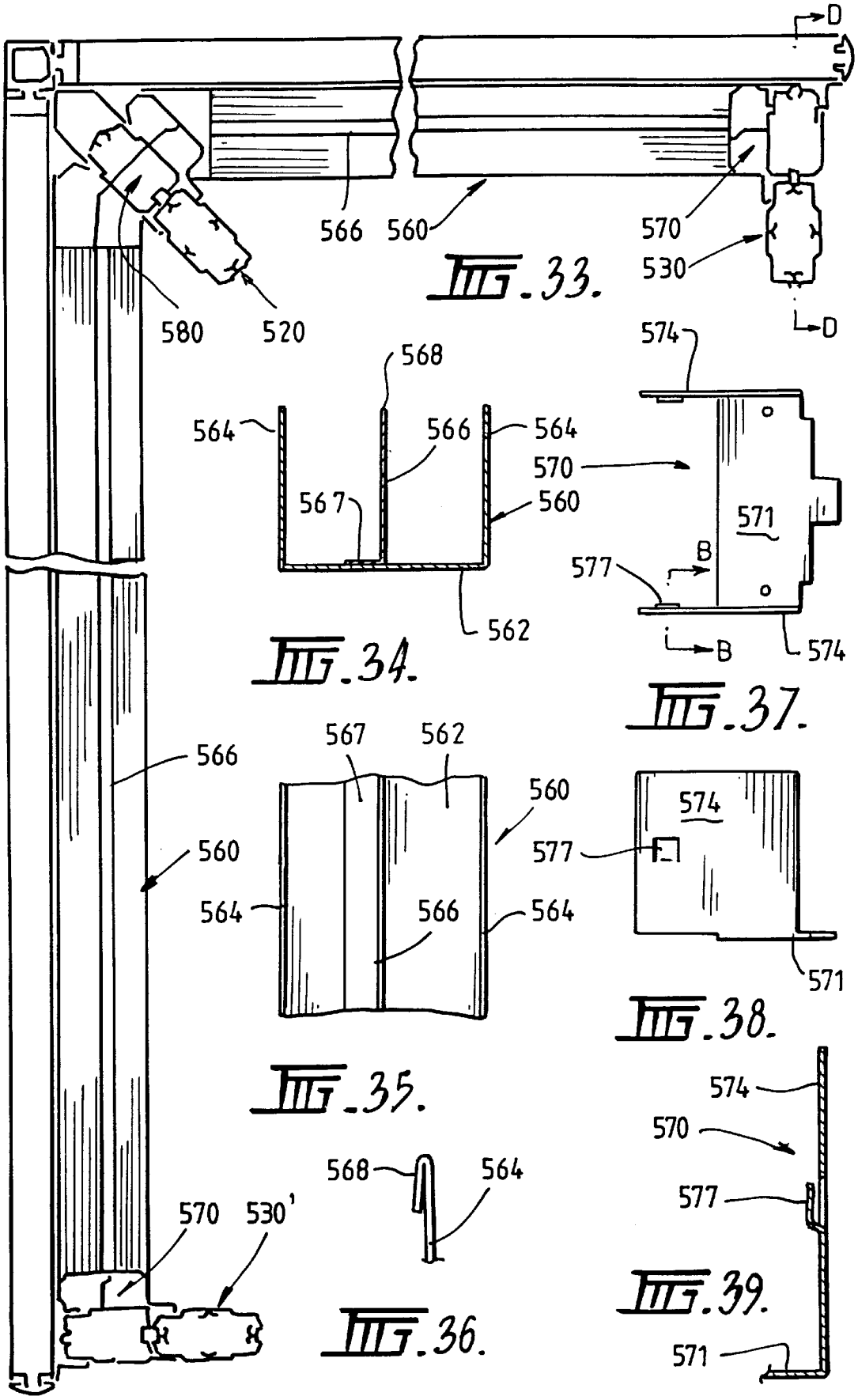
FIG. 33 is a plan view of a cable tray and duct assembly for the desk of FIG. 30.
FIG. 34 is a section through the cable tray of the assembly of FIG. 30.
FIG. 35 is a plan view of part of the cable tray.
FIG. 36 is an enlarge detail of an end portion of the wall of the cable tray.
FIG. 37 is a plan view of an end connection piece of the cable tray assembly.
FIG. 38 is a side view of the end piece of FIG. 37.
FIG. 39 is an enlarged section on the line B—B of FIG. 37.
Figure 40:
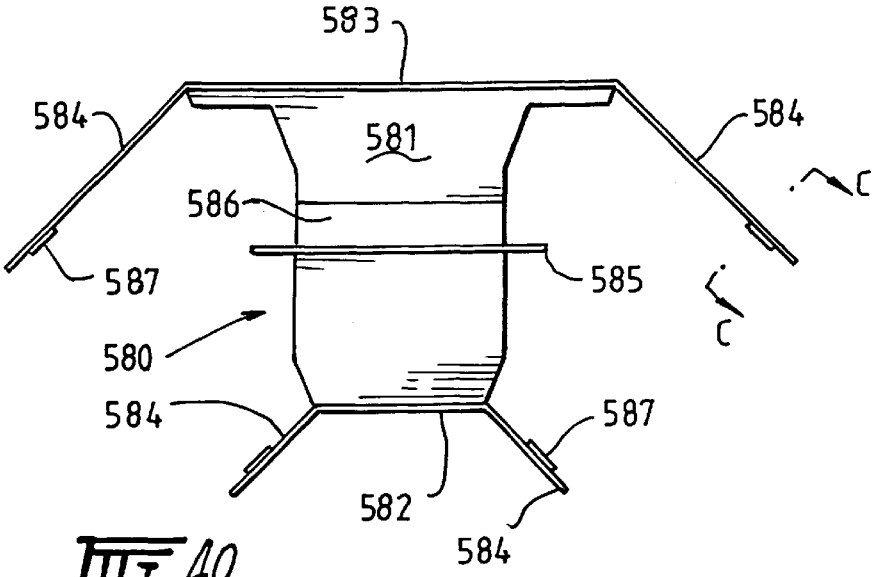
FIG. 40 is a plan view of a corner connection piece of the cable tray assembly.

As shown in FIGS. 30, 33 and 40, a vertically extending expansion duct 555 is attached to the lower part 531 of each leg 530, 530', 520, and a horizontally extending cable tray 560 for electrical, computer and/or communications cable extends between the corner leg 520 and each of the end legs 530, 530'. Each cable tray 560 comprises a generally U-shaped channel having a base 562 and two side walls 564. Each tray 560 is also provided with a partition 566 extending longitudinally along its length which divides the tray into two compartments. The partition 566 may conveniently be formed from an L-shaped metal member having a shorter limb 567 welded to the base and a longer limb 568 extending upwards from the base 562.

The ends of the cable trays 560 are supported by connection pieces 570, 580 mounted on the upper ends of the expansion ducts 555. As shown in FIGS. 37 to 39 each end connection piece 570 has a base plate 571 and a pair of side plates 574 extending upwardly from the base plate 571.

Figure 42:
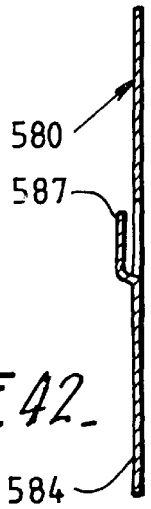
FIG. 42 is an enlarged section on line C—C of FIG. 40.
Figure 41:
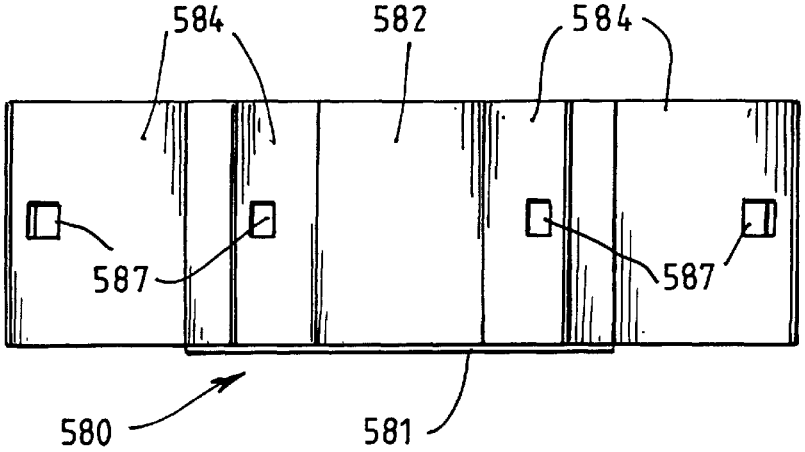
FIG. 41 is a front view of the corner piece of FIG. 40.

The corner connection piece 580 shown in FIGS. 40 to 42 has a base plate 581, front and rear walls 582, 583 and a side plate 584 at each side of the front and rear walls 582, 583 extending at an angle of approximately 45° to the front and rear walls 582, 583. The corner connection piece may have a central dividing plate 585 similar to the partition 568 extending upwardly from its base plate 581. The base plate 571, 581 of each connection piece may be attached to the upper surface of the expansion duct 555 of a respective leg 530, 530', 520 in any convenient manner, for instance by spot welding.

Each of the side plates 574, 584 of the connection pieces 571, 581 is provided with duct mounting element 577, 587 for engaging and supporting an end of a respective cable duct 560. As shown in FIGS. 39 and 42, the duct mounting element 577, 587 of each side plate 574, 584 comprises a tab formed by cutting out three sides of a square from the side plate 574, 584 leaving the lowest side of the square joined to the side plate. Each tab 577, 587 is adapted to be engaged by a hook-like formation 568 such as shown in FIG. 36 provided on the upper edge of an end portion of a respective one of the side walls 564 of the cable tray 560, thus supporting the cable trays 560 between the connection pieces 570, 580 on the expansion ducts 555 of the leg 520, 530, 530'.

Figure 43:
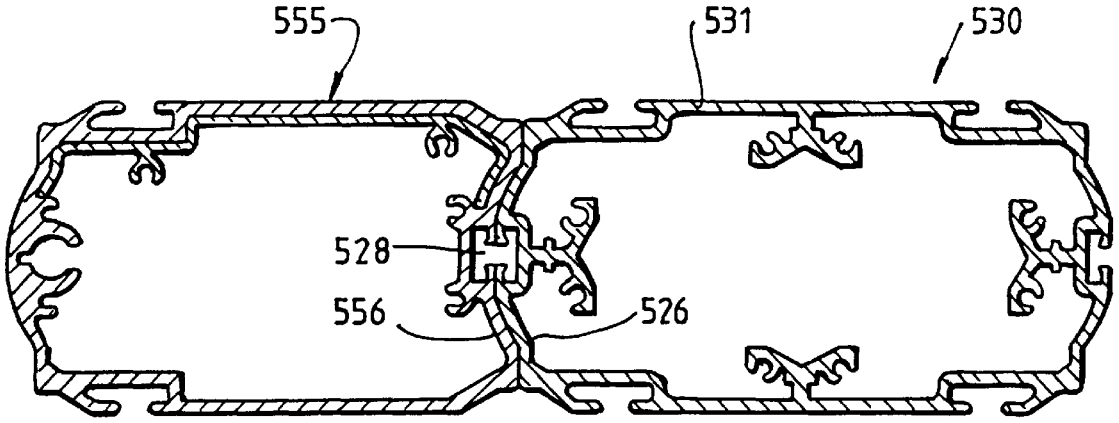
FIG. 43 is an enlarged section on the line D—D of FIG. 33.

As shown in FIG. 43, the expansion duct 555 is of hollow form. Preferably the base plate 571, 581 of a connection piece 570, 580 for at least one of the expansion ducts does not extend across all of the upper end of its respective hollow expansion duct 555 so that, if required, one or more cables for electricity computer or communications may be provided within the expansion duct 555.

As shown in FIG. 30, an outlet socket 575 may be mounted to the cable tray 560 at any convenient position by a mounting piece 576 adapted to clip onto the upper ends of the side plates 564 of the cable tray 560. The outlet socket 575 may be a power outlet socket of a modular wiring system such as that which is sold under the Trade Mark INTERPOWER in Australia. Alternatively, the outlet socket may be a computer or telecommunications socket, and it will be appreciated that different types of sockets for different purposes may be provided at different locations on the cable tray 560.

The expansion duct 555 may be attached to the column 531 of the lower leg part by any convenient means. For instance, side walls 556, 526 of a respective duct 555 and column 531 may define a generally H-shaped vertical channel 528 as shown in FIG. 43 which is adapted to receive a complementary H-shaped attachment member 529.

Referring to FIGS. 30, 31 and 44 to 46, a duct cover 590 is attached to the rear or outer edge 513, 514 of each limb 511, 512 of the desk-top member 510. Each duct cover 590 comprises an elongate strip which is hingedly attached to the desk-top member by a pivotal mounting comprising a cover mounting member 591 secured to the desk top member 510 and a pivot piece 592 received between retaining portions 593, 594 of the mounting member 592 and the duct cover 590.

The pivot piece 592 is generally E-shaped in cross-section having curved limbs 595 with enlarged heads 596 extending on either side of a central protuberance 597. The retaining portions 593, 594 of the duct cover 590 and mounting member 591 are of similar shape having upper and lower limbs 598, 599 defining a channel therebetween for receiving a respective one of the curved limbs 595 of the pivot piece 592.

Figure 44:
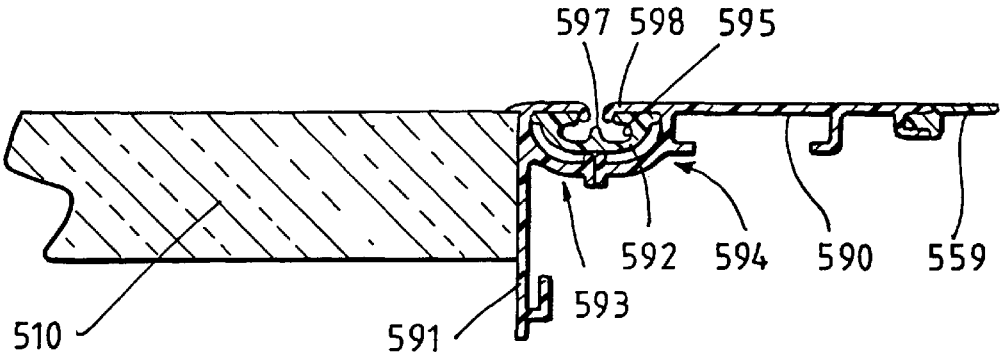
FIG. 44 is an enlarged section through a hinged duct cover of the desk in a closed portion.
Figure 45:
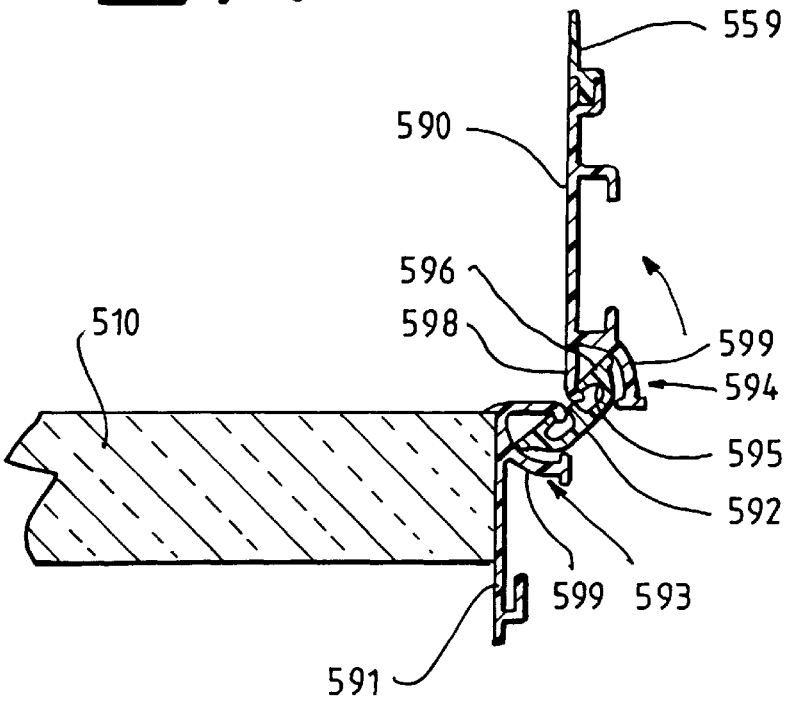
FIG. 45 is a section similar to FIG. 44 showing the duct cover in an intermediate position.
Figure 46:
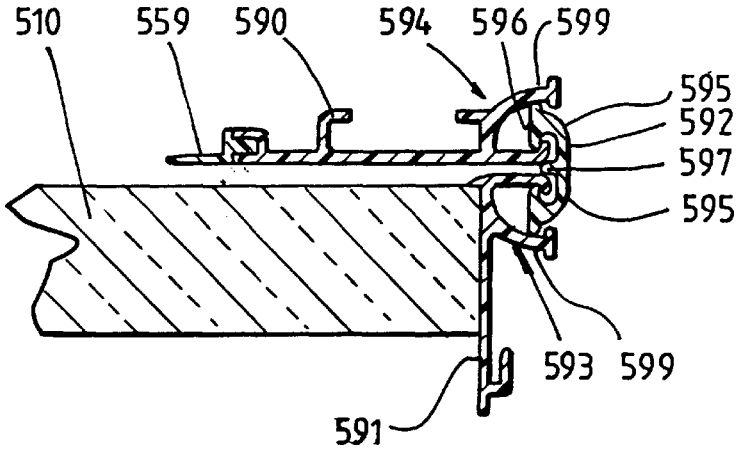
FIG. 46 is a section similar to FIG. 44 showing the duct cover in an open position.

It will be seen from FIGS. 44 to 46 that the arrangement of the duct cover 590, mounting member 591 and pivot piece 592 is such that the duct cover 590 is pivotally movable from a first closed position as shown in FIGS. 30 and 45 in which the duct cover extends horizontally at substantially the same level as the upper surface of the desk-top member 510 to cover the duct 555 and cable tray 560, through an intermediate position as shown in FIG. 45, to a second, open position in which the duct cover extends substantially horizontally directly above the peripheral rear edge portion of the desk top member 510. The open position of the duct cover member 590 allows access to the duct 555, cable tray 560 and outlet socket(s) for connection or disconnection of electrical, computer and/or communications equipment.

The duct cover 590 and mounting member 591 are conveniently formed from aluminum extrusions, and a rubber seal 559 is preferably affixed to the edge of the duct cover remote from its pivot piece retaining portion 594.

It will be appreciated that various modifications and alterations may be made to the embodiments of the invention described above without departing from the scope or spirit of the present invention which is defined in the accompanying claims.

I claim:

1. A height adjustable leg for a desk or workstation comprising a first leg part adapted to stand on a floor surface, a second leg part adapted to be fixed to a top member of the desk, work-station or the like and means for adjusting the height of the second leg part relative to the first leg part, wherein a duct for cabling is attached to the first leg part, said duct comprising a hollow duct member extending vertically alongside the first leg part.

2. A height adjustable leg according to claim 1 wherein said duct member and said first leg part have adjacent side walls which define a generally H-shaped vertical channel adapted to receive a complementary H-shaped attachment member for attaching said duct member to said first leg part.

3. A height adjustable leg according to claim 1 wherein the duct for cabling includes at least one outlet socket.

4. A height adjustment system for a desk or workstation including a plurality of height adjustable legs in accordance with claim 1 and further including at least one cable tray extending substantially horizontally between a pair of height adjustable legs of the system, said cable tray being supported on upper ends of said duct members attached to said first leg parts of the pair of legs.

5. A height adjustment system according to claim 4, wherein said cable tray includes at least one partition for dividing said cable tray into compartments for different types of cables.

6. A height adjustment system according to claim 4, wherein said cable tray includes at least one outlet socket.

7. A height adjustment system according to claim 4 further comprising a cover member is attached to said top member at a location above the cable tray.

8. A height adjustment system according to claim 7, wherein said cover member is pivotally connected to an edge of said top member.

9. A height adjustment system according to claim 8, wherein said cover member is movable relative to said top member from a first position in which said cover member extends substantially horizontally outwardly from said top member to a second position allowing access to said cable tray.

10. A height adjustment system according to claim 9, wherein said cover member is pivotally connected to said top member by a pivotal mounting comprising a cover mounting member attached to said top member and a pivot piece having curved limbs received in complementary receiving portions of said cover member and said cover mounting member.

11. A height adjustment system for a desk or work-station comprising a top member supported by a plurality of height adjustable legs each having a first leg part, and a second leg part adapted to be fixed relative to the top member, said second leg part being movable relative to the first leg part in a substantially vertical direction, said second leg part including a gearbox housing containing a crown gear rotatable about a substantially vertical axis and at least one pinion gear engageable with said crown gear and rotatable about a substantially horizontal axis, said gearbox housing containing at least one ball bearing race assembly provided between said gearbox housing and at least one of said gears wherein said gearbox housing of at least one of said height adjustable legs includes a plurality of pinion gears, one of said plurality of pinion gears being connected to drive means for rotating said pinion gear and another of said plurality of pinion gears being connected by drive transmission means to the pinion gear of another height adjustable leg of the system, and at least one cable tray extending substantially horizontally between a pair of the height adjustable legs.

12. A height adjustment system according to claim 11 wherein the cable tray is supported on the upper ends of vertically extending duct members attached to the height adjustable legs.

13. A height adjustment system according to claim 11 wherein the cable tray includes at least one partition for dividing the tray into different compartments for different types of cables.

14. A height adjustment system according to claim 11 wherein the cable tray includes at least one outlet socket.

15. A height adjustment system according to claim 11 wherein a cover member is attached to the top member at a location above the cable tray.

16. A height adjustment system according to claim 15 wherein the cover member is pivotally connected to an edge of the top member.

17. A height adjustment system according to claim 16 wherein the cover member is movable relative to the top member from a first position in which it extends substantially horizontally outwardly from the top member to a second position allowing access to the cable tray.

18. A height adjustment system according to claim 17 wherein the cover member is pivotally connected to the top member by a pivotal mounting comprising a cover mounting member attached to the top member and a pivot piece having curved limbs received in complementary receiving portions of the cover member and over mounting member.

19. A height adjustment system for a desk or workstation comprising a top member supported by a plurality of height adjustable legs each having a first leg part, a second leg part adapted to be fixed relative to said top member and means for adjusting the height of said second leg part relative to said first leg part, wherein each of said height adjustable legs is disposed underneath a side or rear edge of said top member, a pair of spaced apart support beams extending between adjacent pairs of said legs, each beam of said pair of support beams being disposed at substantially the same horizontal level and extending substantially parallel to one another, said support beams clamped between upper and lower clamping members, said top member being supported in a cantilever arrangement from said support beams.

20. A height adjustment system according to claim 19 wherein said upper clamping members are secured to said top member.

21. A height adjustment system according to claim 20 wherein the upper clamping members comprise cantilever support arms extending substantially horizontally from the support beams.

22. A height adjustment system according to claim 19 wherein the lower clamping members comprise upper leg parts of the height adjustable legs.

23. A height adjustment system according to claim 19 wherein the lower clamping members are secured to upper leg parts of the height adjustable legs.

24. A height adjustment system according to claim 19 wherein the support beams are clamped between upper and lower clamping members provided at locations between the height adjustable legs.

25. A height adjustment system according to claim 19 wherein said upper and lower clamping members are secured together with at least one support beam clamped therebetween by securing means.

26. A height adjustment system according to claim 19 wherein the support beams are formed from roll-formed steel.

27. A height adjustment system according to claim 19 wherein said upper and lower clamping members have projections or recesses which engage with complementary recesses or projections in said support beams.

28. A height adjustment system according to claim 27 wherein the support beams are of hollow form having substantially vertical straight sides and upper and lower end portions with recesses or depressions therein for engagement by complementary formations on the upper and lower clamping members.

29. A height adjustment system for a desk or workstation comprising a top member and a plurality of height adjustable legs, each leg comprising a first leg part adapted to stand on a floor surface, and a second leg part adapted to be fixed relative to said top member, said second leg part being movable relative to said first leg part in a substantially vertical direction, said second leg part including a gearbox housing containing a crown gear rotatable about a substantially vertical axis and at least one pinion gear engageable with said crown gear and rotatable about a substantially horizontal axis, said gearbox housing containing at least one ball bearing race assembly provided between said gearbox housing and at least one of said gears wherein said gearbox housing of at least one of said height adjustable legs includes a plurality of pinion gears, one of said plurality of pinion gears being connected to drive means for rotating said pinion gear and another of said plurality of pinion gears being connected by drive transmission means to the pinion gear of another height adjustable leg of the system, said system including a hollow vertically extending duct member for cabling attached to the first leg part of at least one of said height adjustable legs.

30. A height adjustment system according to claim 29, wherein said at least one ball bearing race assembly includes a first bearing race member having a substantially part-spherical concave surface, a second bearing race member having a substantially part-spherical concave surface and a plurality of ball bearings received between said substantially part-spherical concave surfaces, said first and second bearing race members being formed from a low-friction plastic material.

31. A height adjustment system according to claim 29, wherein the second leg part includes a generally vertically extending rotatable shaft on which said crown gear is mounted, said rotatable shaft having a screw-threaded portion, and said first leg part includes a nut engaged with said screw-threaded portion, whereby rotation of said crown gear causes said second leg part to move substantially vertically relative to said first leg part.

32. A height adjustment system according to claim 31, wherein said crown gear is of hollow form having a bevel gear portion, a shaft portion extending from said bevel gear portion and a bore adapted to receive the upper end of said rotatable shaft for mounting said crown gear on said rotatable shaft.

33. A height adjustment system according to claim 32, wherein said gearbox housing includes a housing base member and a gearbox cover member, and a ball bearing race assembly between said shaft portion of said crown gear and said gearbox base or cover member.

34. A height adjustment system according to claim 31, wherein said second leg part includes a generally vertically extending tubular member surrounding said vertically extending rotatable shaft, and a pair of low friction half nuts are received on said screw-threaded portion of said shaft and attached to said tubular member.

35. A height adjustment system according to claim 29, wherein said at least one pinion gear is provided on a generally horizontally extending rotatable shaft adapted to be connected to drive means for rotating said rotatable shaft, and said pinion gear comprises a bevel gear portion and a spigot portion for mounting said pinion gear on said rotatable shaft.

36. A height adjustment system according to claim 29, wherein said duct member and said first leg part have adjacent side walls which define a generally H-shaped vertical channel adapted to receive a complementary H-shaped attachment member for attaching said duct member to said first leg part.

37. A height adjustment system according to claim 29, wherein a cable tray extends substantially horizontally between a pair of height adjustable legs, each of said legs having a hollow vertically extending duct member, said cable tray being supported on upper ends of said vertically extending duct members.

38. A height adjustable leg for a desk or workstation comprising:

a first leg part adapted to stand on a floor surface;

a second leg part adapted to be fixed relative to a top member of said apparatus, said second leg part being movable relative to said first leg part in a substantially vertical direction;

and at least one adjustable linear bearing provided between said relatively movable first and second leg parts, said linear bearing comprising a bearing body fixed to one of said leg parts, said bearing body having upper and lower expandable bearing regions providing bearing surfaces for the other of said leg parts, and upper and lower wedge members received in respective recesses in said upper and lower regions for expanding said regions to compensate for wear of said bearing surfaces, said leg including a hollow vertically extending duct member for cabling attached to the first leg part of said plurality of leg parts.

39. A height adjustable leg according to claim 38, wherein the adjustable linear bearing further comprises spring means for urging at least one of said wedge members into the recess in its respective bearing region of said bearing body so that the bearing automatically compensates for wear of the bearing surface of said bearing region.

40. A height adjustable leg according to claim 39, wherein the linear bearing further comprises an elongate connecting member attached to said lower wedge member and extending upwardly between said expandable bearing regions and through a bore in said upper wedge member, and spring means received on a portion of said elongate connecting member above said upper wedge member for urging said upper and lower wedge members into their respective recesses in said upper and lower bearing regions, whereby said linear bearing is automatically self-adjusting to compensate for wear of said bearing surfaces.

41. A height adjustable leg according to claim 38, wherein said bearing body and said wedge members are formed from a low friction plastics material and said wedge members have an angle of taper less than the friction angle of said low friction plastics material.

42. A height adjustable leg for a desk or workstation comprising a first leg part adapted to stand on a floor surface, and a second leg part adapted to be fixed to a top member of said desk or workstation, said second leg part being movable relative to said first leg part in a substantially vertical direction, said second leg part including a gearbox housing containing a crown gear rotatable about a substantially vertical axis and at least one pinion gear engageable with said crown gear and rotatable about a substantially horizontal axis, said gearbox housing containing at least one ball bearing race assembly provided between said gearbox housing and at least one of said gears, wherein the second leg part includes a generally vertically extending rotatable shaft on which said crown gear is mounted, said rotatable shaft having a screw-threaded portion, and said first leg part includes a nut engaged with said screw-threaded portion, whereby rotation of said crown gear causes said second leg part to move substantially vertically relative to said first leg part, and wherein said crown gear is of hollow form having a bevel gear portion, an upper shaft portion extending upwardly from said bevel gear portion and a bore adapted to receive the upper end of said rotatable shaft for mounting said crown gear on said rotatable shaft, said height adjustable leg having a hollow vertically extending duct member for cabling attached to the first leg part.

43. A height adjustable leg according to claim 42, wherein said duct member and said first leg part have adjacent side walls which define a generally H-shaped vertical channel adapted to receive a complementary H-shaped attachment member for attaching said duct member to said first leg part.

44. A height adjustable leg for a desk or workstation comprising a first leg part adapted to stand on a floor surface, and a second leg part adapted to be fixed to a top member of said desk or workstation, said second leg part being movable relative to said first leg part in a substantially vertical direction, said second leg part including a gearbox housing containing a crown gear rotatable about a substantially vertical axis and at least one pinion gear engageable with said crown gear and rotatable about a substantially horizontal axis, said gearbox housing containing at least one ball bearing race assembly provided between said gearbox housing and at least one of said gears, wherein the second leg part includes a generally vertically extending rotatable shaft on which said crown gear is mounted, said rotatable shaft having a screw-threaded portion, and said first leg part includes a nut engaged with said screw-threaded portion, whereby rotation of said crown gear causes said second leg part to move substantially vertically relative to said first leg part wherein said second leg part includes a generally vertically extending tubular member surrounding said rotatable shaft, and a pair of low friction half nuts are received on said screw-threaded portion of said shaft and attached to said tubular member, said height adjustable leg having a hollow vertically extending duct member for cabling attached to the first leg part.

45. A height adjustable leg according to claim 44, wherein said duct member and said first leg part have adjacent side walls which define a generally H-shaped vertical channel adapted to receive a complementary H-shaped attachment member for attaching said duct member to said first leg part.

46. A height adjustable leg for a desk or workstation comprising a first leg part adapted to stand on a floor, and a second leg part adapted to be fixed to a top member of said desk or workstation, said second leg part being movable relative to said first leg part in a substantially vertical direction, said second leg part including a gearbox housing containing a crown gear rotatable about a substantially vertical axis and at least one pinion gear engageable with said crown gear and rotatable about a substantially horizontal axis, said gearbox housing containing at least one ball bearing race assembly provided between said gearbox housing and at least one of said gears, wherein said first leg part includes a vertically extending column, said second leg part includes a vertically extending member within said column and at least one adjustable linear bearing between said column and said vertically extending member, said height adjustable leg including a hollow vertically extending duct member for cabling attached to said first leg part.

47. A height adjustable leg according to claim 46, wherein said duct member and said first leg part have adjacent side walls which define a generally H-shaped vertical channel adapted to receive a complementary H-shaped attachment member for attaching said duct member to said first leg part.

48. A height adjustment system for a desk or work-station comprising a top member and a plurality of height adjustable legs, each leg comprising a first leg part adapted to stand on a floor surface, and a second leg part adapted to be fixed to said top member, said second leg part being movable relative to said first leg part in a substantially vertical direction, said second leg part including a gearbox housing containing a crown gear rotatable about a substantially vertical axis and at least one pinion gear engageable with said crown gear and rotatable about a substantially horizontal axis, said gearbox housing containing at least one ball bearing race assembly provided between said gearbox housing and at least one of said gears wherein said gearbox housing of at least one of said height adjustable legs includes a plurality of pinion gears, one of said plurality of pinion gears being connected to drive means for rotating said pinion gear and another of said plurality of pinion gears being connected by drive transmission means to the pinion gear of another height adjustable leg of the system, each height adjustable leg being disposed underneath a side or rear edge of the top member and the top member is supported by at least one generally horizontally extending cantilever member.

* * * * *

UNITED STATES PATENT AND TRADEMARK OFFICE

CERTIFICATE OF CORRECTION

PATENT NO. : 5,890,438
DATED : April 6, 1999
INVENTOR(S) : R.G. Frankish

It is certified that error appears in the above-identified patent and that said Letters Patent is hereby corrected as shown below:

| COLUMN | LINE | |
|---|---|---|
| Title page, item [30] | Foreign App. Priority Data | "9601442" should read --9601442-8-- |
| 18 (Claim 18, line 6) | 30 | "over" should read --cover-- |

Signed and Sealed this

Twenty-eighth Day of September, 1999

*Attest:*

Q. TODD DICKINSON

*Attesting Officer*

*Acting Commissioner of Patents and Trademarks*